US005416492A

United States Patent [19]

Takahashi et al.

[11] Patent Number: 5,416,492

[45] Date of Patent: May 16, 1995

[54] ELECTROMAGNETIC RADIATOR USING A LEAKY NRD WAVEGUIDE

[75] Inventors: Akira Takahashi, Ageo; Atsushi Kaise, Ohmiya; Tsukasa Yoneyama, 12-17, Kodaira, Fukurobara, Taihaku-ku, Sendai-shi, Miyagi 981-31; Yoshihiko Wagatsuma, 4-16-20, Tsurugaoka, Izumi-ku, Sendai-shi, Miyagi 981-31, all of Japan

[73] Assignees: Yagi Antenna Co., Ltd., Tokyo; Tsukasa Yonehara; Yoshihiko Wagatsuma, both of Miyagi, all of Japan

[21] Appl. No.: 40,622

[22] Filed: Mar. 31, 1993

[51] Int. Cl.[6] ..... H01Q 13/10; H01Q 13/20

[52] U.S. Cl. ..... 343/771; 343/700 MS; 333/237

[58] Field of Search ..... 343/767, 770, 700 MS File, 343/776, 785, 789, 872, ; 333/157, 237, 239, 248; H01Q 43/10, 13/28

[56] References Cited

U.S. PATENT DOCUMENTS

| | | | |
|---|---|---|---|
| 3,530,478 | 9/1970 | Corzine et al. | 343/771 |
| 4,463,330 | 7/1984 | Yoneyama | 333/239 |
| 4,468,673 | 8/1984 | Stern et al. | 343/770 |
| 4,536,767 | 8/1985 | Rembold et al. | 343/785 |
| 4,618,865 | 10/1986 | Lamensdorf et al. | 343/776 |
| 4,970,522 | 11/1990 | Niman | 333/237 |

FOREIGN PATENT DOCUMENTS

| | | | |
|---|---|---|---|
| 3210895A1 | 9/1983 | Germany . | |
| 0037350 | 4/1978 | Japan | 343/771 |

OTHER PUBLICATIONS

Annales Des Telecommunications (Annals of Telecommunications) vol. 47, No. 11-12; Nov.-Dec. 1992; pp. 508-514; T. Yoneyama, France.

1987 International Symposium Digest Atennas and Propagation vol. I, Jun. 1987, Blacksburg, Va. pp. 372-375, Malherbe et al, Planar Slot Array Fed By Coupled Dielectric Lines In a Metal Waveguide.

Conference Proceedings 20th European Microwave Conference 90 vol. 1, Sep. 1990, Budapest, Hungary, pp. 95-104, Oliner a New Class of Scannable Millimeter-Wave Antennas.

Alta Frequenza, vol. 58, No. 5/6, Sep. 1989, Milano, Italy pp. 55-69, Oliner Recent Developments In Millimeter-Wave Antennas.

IEEE Transactions On Microwave Theory and Techniques, vol. MTT-35, No. 8, Aug. 1987; A New Leaky Waveguide for Millimeter Waves Using Nonradiative Dielectric (NRD) Waveguide—Part I: Accurate Theory; Sanchez et al; pp. 737-747.

IEEE Transactions On Microwave Theory and Techniques, vol. MTT-35, No. 8, Aug. 1987; A New Leaky Waveguide for Millimeter Waves Using Nonradiative Dielectric (NRD) Waveguide—Part II: Comparison with Experiments; Qing et al; pp. 748-752.

Proceedings of ISAP '85; Experimental Study of Nonradiative Dielectric Waveguide Leaky Wave Antenna; Yoneyama et al; pp. 85-88.

*Primary Examiner*—Donald Hajec
*Assistant Examiner*—Tan Ho
*Attorney, Agent, or Firm*—Frishauf, Holtz, Goodman & Woodward

[57] ABSTRACT

Dielectric strips made of a dielectric material are placed between a pair of conductor plates located a specified distance apart. Cutouts are formed in the dielectric strips. The cutouts, a part of each dielectric strip is formed into an electrically asymmetric portion. When high-frequency power is supplied to the dielectric strips, the power is transmitted through an NRD waveguide composed of the dielectric strips and the pair of conductor plates, with the result that electromagnetic wave is radiated from the cutouts into the space between the conductor plates. This electromagnetic wave excites the radiation elements formed in the conductor plates, which then radiate electromagnetic waves.

21 Claims, 32 Drawing Sheets

FIELD STRENGTH BETWEEN LEAKY NRD LINENS x-y PLANE ELECTRIC FIELD DISTRIBUTION y-z PLANE ELECTRIC FIELD DISTRIBUTION

ELECTROMAGNETIC RADIATOR USING A LEAKY NRD WAVEGUIDE

BACKGROUND OF THE INVENTION

1. Field of the Invention

This invention relates to an electromagnetic radiator, such as an antenna, using a leaky NRD (nonradiative dielectric) waveguide. More specifically, this invention relates to an electromagnetic radiator that features a compact design and a simple configuration and assures high efficiency up to a high-frequency band. A radiator of this invention is used as a receiving antenna for satellite broadcasting, an electromagnetic radiator for a car anti-collision unit, and a write/read transducer for IC cards, identification tags, and others.

2. Description of the Related Art

Coaxial lines, microstrip lines, triplate lines, metal waveguides, and the like have been used as power feed lines for antennas or the like. Those power feed lines have the disadvantage that their loss becomes greater as the frequency of a carrier, such as millimeter wave, gets higher. The metal waveguides are difficult to miniaturize because of their configuration.

Recently, there have been demands that electromagnetic radiators such as antennas should be made compact for various uses and operate efficiently even at high frequencies.

For example, the popularization of satellite broadcasting has been requiring more compact, highly efficient satellite-broadcasting receiving antennas. So-called IC cards, which are cards incorporating integrated circuits, are also being popularized. Most conventional IC cards use contact-type data write/read transducers. Since such a contact type is less reliable, non-contact type transducers are desirable. By incorporating in such IC cards transducers capable of remotely writing and reading at a distance several to several tens of meters apart, IC cards of this type can be used as identification cards for individuals or cars, which makes it possible to construct an effective security management system. Further, by installing such IC cards on pallets, containers, or the like, a distribution management system can be constructed. Still further, now under consideration is the construction of a traffic control system where cars are provided with small antennas and data is exchanged between such cars and transmitter-receivers installed along the roads to provide traffic control and traffic information. Additionally, an anti-collision radar system is also under consideration which requires cars to be provided with small antennas that prevent them from colliding against each other.

It is desirable that electromagnetic radiators such as antennas or transducers used in systems as described above, should be as small as possible, simple in configuration, and efficient even in high-frequency bands. With conventional electromagnetic radiators such as antennas, however, it is difficult to meet such requirements.

SUMMARY OF THE INVENTION

Accordingly, the object of the present invention is to provide an electromagnetic radiator, such as an antenna, that is compact and simple in configuration and allows efficient use even in high-frequency bands.

The foregoing object is accomplished by using NRD (nonradiative dielectric) waveguides as power feed lines. The NRD waveguide is such that a dielectric strip is placed between a pair of conductor plates. While high-frequency power is being transmitted through the dielectric strip, a symmetric electric field is formed between the conductor plates, which enables the high-frequency power to be transmitted with very low loss.

When electrically asymmetric portions are formed in a part of such an NRD waveguide, the electric field becomes asymmetric at those portions, which permits part of the high-frequency power transmitted to be radiated in the form of electromagnetic wave from those portions into the space between the pair of conductor plates. The NRD waveguide having such electrically asymmetric portions is called the leaky NRD waveguide. The electrically asymmetric portions may have such a simple construction as cutouts formed in a part of the dielectric.

An electromagnetic radiator using such a leaky NRD waveguide provides very high efficiency up to high-frequency bands, since the NRD waveguide presents a very low loss even in very high-frequency bands such as a millimeter-wave band. Just forming electrically asymmetric portions, such as cutouts, in a part of the NRD waveguide allows electromagnetic waves to be radiated from those portions. This leads to a very simple configuration as well as a compact design. More than one cutout and the related portion can be formed in a desired arrangement along the NRD waveguide. Therefore, by combining electromagnetic waves radiated from those cutouts with other radiation elements, for example, the opening elements formed in the conductor plates, a desired type of antenna or radiator can be constructed easily.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are corporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
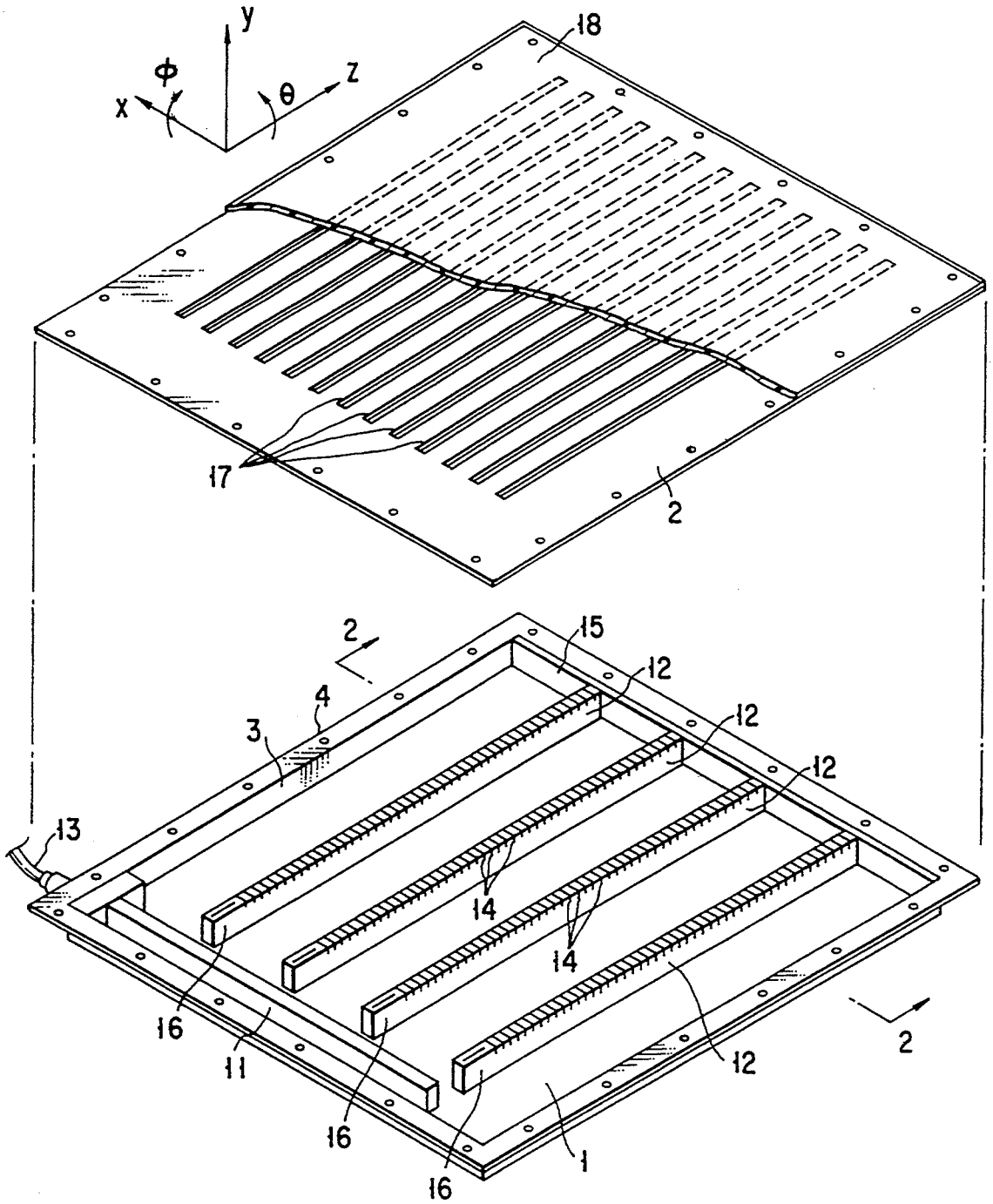
FIG. 1 is a partially cutaway view in perspective of a plane antenna according an embodiment of the present invention.
Figure 2:
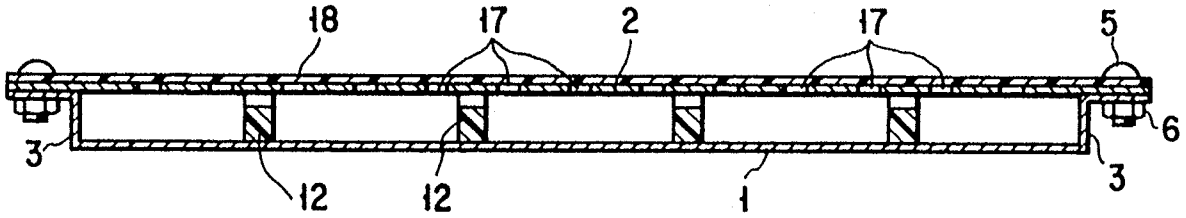
FIG. 2 is a sectional view taken along line 2—2 of FIG. 1.
Figure 3:
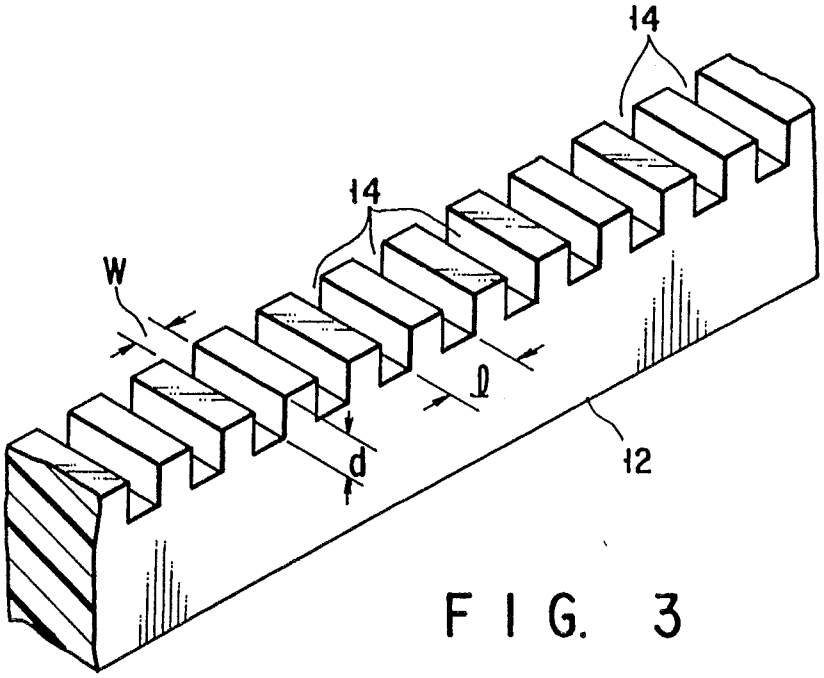
FIG. 3 is a perspective view of the dielectric strip of FIG. 1.

Referring to the accompanying drawings, embodiments of the present invention will be explained. FIGS. 1 through 3 show a plane antenna for receiving satellite broadcasting to which the present invention is applied. The plane antenna of this embodiment is for receiving linearly polarized waves.

In the figure, numerals 1 and 2 indicate a lower conductor plate and an upper conductor plate, respectively, which are metal plates such as aluminium plates. Conductor walls 3 are integrally formed with the lower conductor plate 1 so as to rise around the periphery of the lower conductor plate 1. Flange portions 4 are integrally formed at the upper ends of the conductor walls 3. The upper conductor plate 2 is placed on the flange portions 4 and secured by means of known means such as bolts and nuts 6. Consequently, the lower conductor plate 1 and the upper conductor plate 2 are located in parallel with each other a specified distance apart.

Between the lower conductor plate 1 and the upper conductor plate 2, a power feed dielectric strip 11 and four dielectric strips 12 are provided. These dielectric strips 11 and 12 are formed of a dielectric material that causes low loss in a millimeter wave band, for example, a fluoroplastic material such as a plastic commercialized under the trademark "Teflon." In this embodiment, their cross-section is rectangular. In addition to the material described above, a synthetic resin material, such as polyethylene plastic, polystyrol plastic, polystyrene plastic, polyether plastic, polypropylene plastic, or polyvinyl chloride plastic, may be used as materials for the dielectric strips 11 and 12.

The single dielectric strip 11, whose cross section is uniform, is placed near and along one conductor wall. As a result, the dielectric strip 11, the lower conductor plate 1, and the upper conductor plate 2 constitute an NRD waveguide. To one end of the NRD waveguide composed of the dielectric strip 11, a high-frequency power of, for example, 22.75 GHz is supplied from a coaxial cable 13. The high-frequency power supplied into the NRD waveguide composed of the dielectric strip 11 is reflected at the other end of the waveguide, with the result that a standing wave is formed in the NRD waveguide.

The four dielectric strips 12 are arranged in parallel with each other in the direction perpendicular to the dielectric strip 11. One end of the dielectric strips 12 is located near one side of the single dielectric strip 11 and electromagnetically connected to the dielectric strip 11. The ends of the dielectric strips 12 are placed in the positions corresponding to integral multiples of the wavelength of the high-frequency power supplied to the NRD waveguide composed of the dielectric strip 11. As a result, the single dielectric strip 11 supplies the high-frequency power of the same phase and the same amplitude to the four dielectric strips 12.

Like the single dielectric strip 11, the four dielectric strips 12, together with the lower conductor plate 1 and the upper conductor plate 2, constitutes the NRD waveguide. In the top face of the four dielectric strips 12, a lot of cutouts 14 are formed to construct what is called a leaky NRD waveguide that permits part of the high-frequency power supplied to leak away in the form of electromagnetic wave.

The cutouts 14 formed in the dielectric strips 12, which are shaped like a rectangular as shown in FIG. 3, are arranged at intervals of less than half the wavelength of the high-frequency power supplied. Since the dielectric strips 12 are electrically asymmetric at the cutouts 14, part of the high-frequency power supplied from the cutouts 14 are radiated in the form of electromagnetic wave into the space between the lower conductor plate 1 and the upper conductor plate 2 so that the electromagnetic waves may be parallel with the conductor plates. Because the distance between the dielectric strips 12 and the distance between the outermost dielectric strips 12 and the side conductor walls 2 are set at integral multiples of the wavelength of the high-frequency power supplied, an electromagnetic standing wave is formed in the space.

On the inside of the conductor wall 3 facing the other end of the four dielectric strips 12, an electro-magnetic wave absorbing wall 15 is provided which prevents the high-frequency power from being reflected at the other end of the dielectric strips 12. On one end of the dielectric strips 12, or on the ends connected to the dielectric strip 11, a mode suppressor portion 16 is provided if necessary.

In the upper conductor plate 2, a plurality of radiation slots 17 are formed as radiation elements. The radiation slots 17 are formed in parallel with each other along the dielectric strips 12. The distance between the radiation slots is set equal to or at an integral multiple of the wavelength of the electromagnetic standing wave in the space. Therefore, the electromagnetic wave existing in the space between the dielectric strips 12 excites the radiation slots 17, which then radiate electromagnetic waves of the same phase and the same amplitude.

On the top of the upper conductor plate 2, a cover 18 is laid which is made of a material that transmits electromagnetic wave, such as synthetic resin or glass. The cover 18 protects the upper conductor plate 12 and prevents rain and dust from entering the inside of the antenna unit via the radiation slots 17.

The dimensions of each portion are suitably set according to the wavelength of the electromagnetic wave received or transmitted. For example, the antenna unit of this embodiment is designed to receive electromagnetic waves of 22.75 GHz with the distance between the lower conductor plate 1 and the upper conductor plate 2 set less than this wavelength, for example, at 5.9 mm. The height of the dielectric strips 11 and 12 is set at 5.9 mm equal to the above distance, and their width is set at 5.4 mm. The width w of the cutouts 14 is set at 1 mm, their depth d is set at 2.5 mm, and their arrangement pitch t is set at 2 mm.

Next shown are the results of testing the characteristics of the above antenna.

Figure 4:
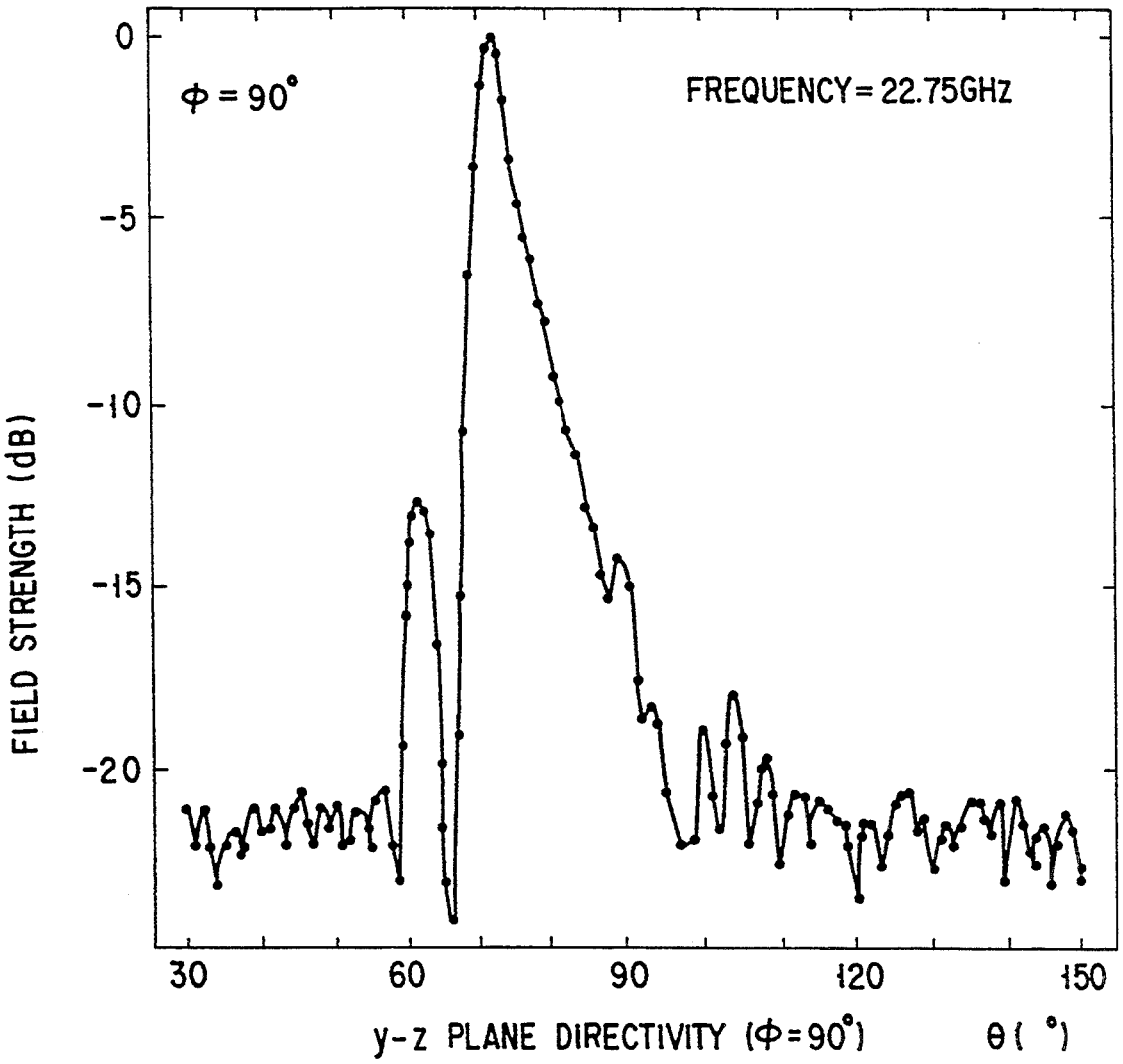
FIGS. 4 through 6 are the electrical characteristic diagrams for the FIG. 1 antenna.

FIG. 4 shows the directional characteristic along the y-z plane of FIG. 1 with the direction of the z axis in FIG. 1 being at $\Theta=0°$. As apparent from FIG. 4, this antenna unit has a sharp directivity and radiates a beam of electromagnetic wave. In the present embodiment, since the phase of the electric field formed between the dielectric strips 12 shifts along the dielectric strips 12, the direction of the maximum field strength is at $\Theta=72.5°$, resulting in a beam tilt. There is a side lobe near $\Theta=62°$, which is caused by the reflected waves existing in the leaky NRD waveguide composed of the dielectric strips 12. By suppressing the reflected waves, the level of the side lobe can be lowered.

Figure 5:
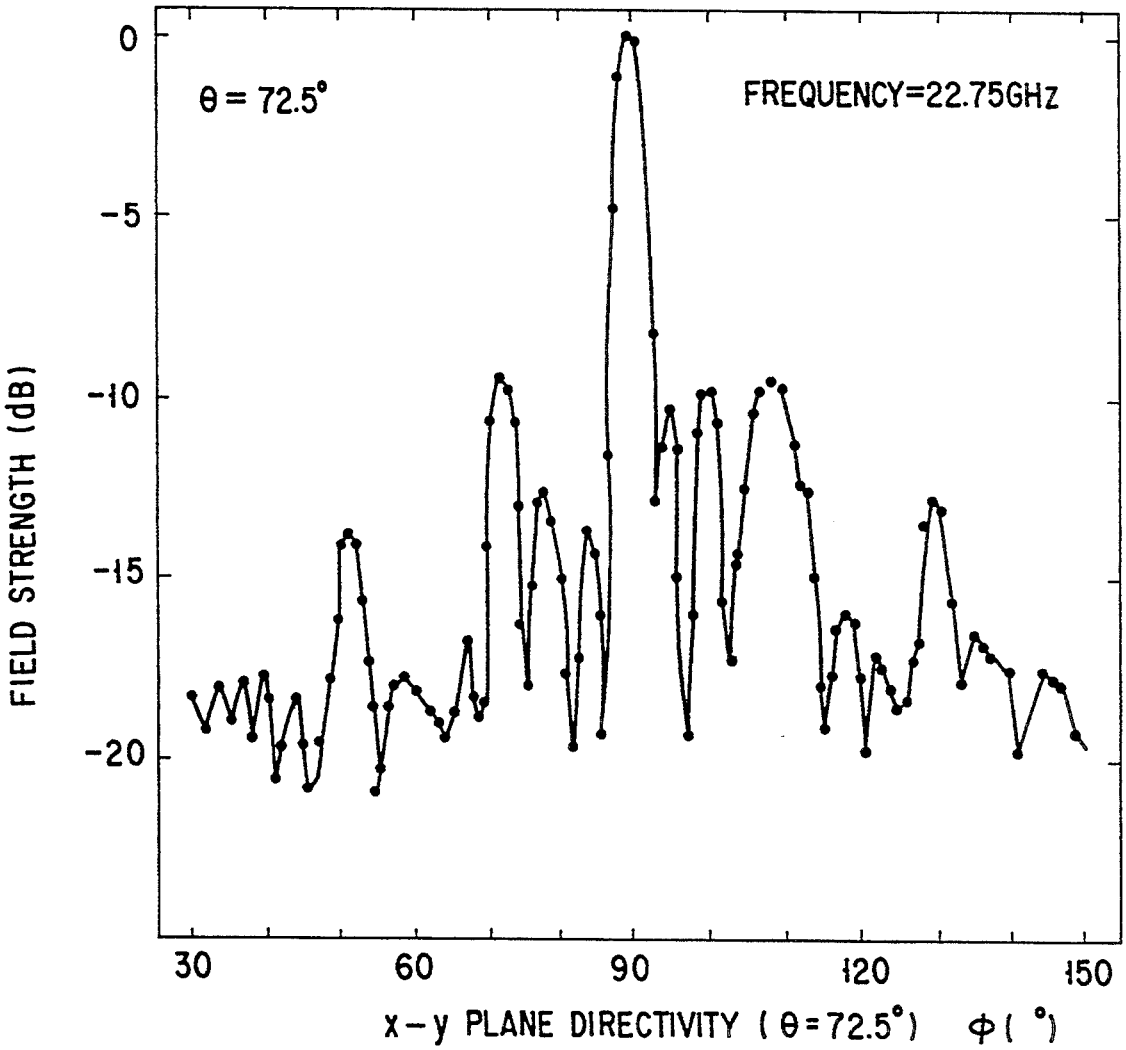

FIG. 5 shows the directional characteristic along the x-y plane of FIG. 1 with the direction of the x axis being at $\Phi=0°$. The measurement of this characteristic was made for the direction $\Theta=72.5°$ in which the FIG. 4 field strength became maximal. Actually, the measurement was made in and along the plane that was tilted so that the x-y plane might be at $\Theta=72.5°$. As seen from FIG. 5, the field strength becomes maximal in the vicinity of $\Phi=90°$ in the x-y direction. Near both sides of the $\Phi=90°$, multiple side lobes of almost the same level exist. Those side lobes can be considered to result from multiple standing waves out of phase with each other between the dielectric strips 12.

Figure 6:
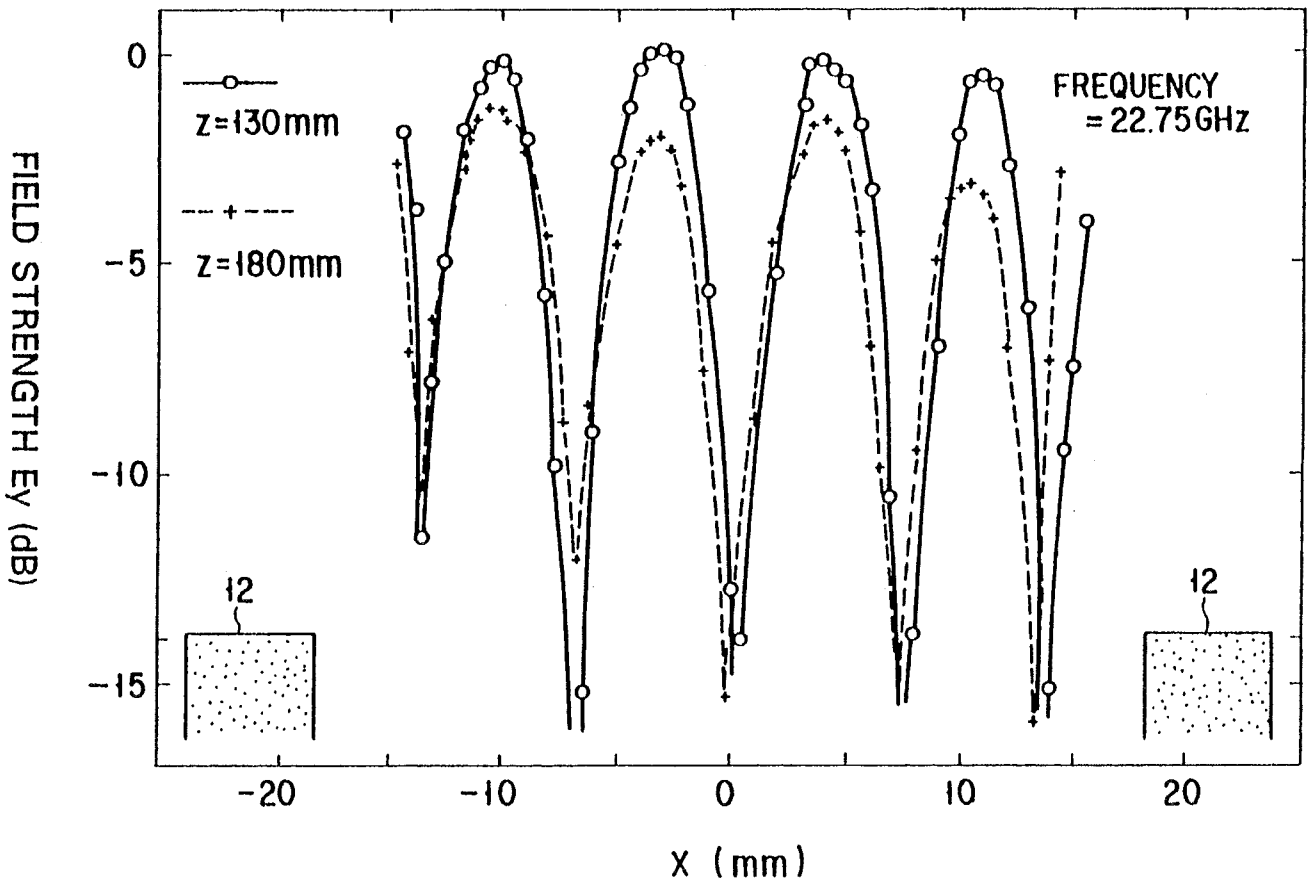

FIG. 6 shows the field strength distribution in the x direction of a standing wave formed between a pair of the dielectric strips 12. In the figure, the position of the two dielectric strips is shown. Here, the solid line indicates the field strength at a point of $z=130$ mm in the z direction from the outermost one of the multiple cutouts 14 in the dielectric strips 12, and the broken line represents the field strength at a point of $z=180$ mm. By placing magnetic field-exciting radiation elements such as the radiation slots 17 in positions corresponding to the bottoms of the field strength in the figure, and placing electric field-exciting radiation elements such as dipole elements or patch elements in positions corresponding to the tops of the field strength, those radiation elements can be connected to each other efficiently.

The results of testing the characteristics of a leaky NRD waveguide composed of the dielectric strips 12 are shown hereinafter. In this test, to eliminate the effect of the elements other than the leaky NRD waveguide, the same dielectric strip 12 as described above was placed between conductor plates 1*a* and 2*a* that had a sufficiently large area and no slit in them. A coaxial line 21, which was located so as to be perpendicular to one end of the dielectric strip 12, supplied power to the dielectric strip 12, on the other end of which a radio wave absorbent 15*a* was provided.

Figure 7:
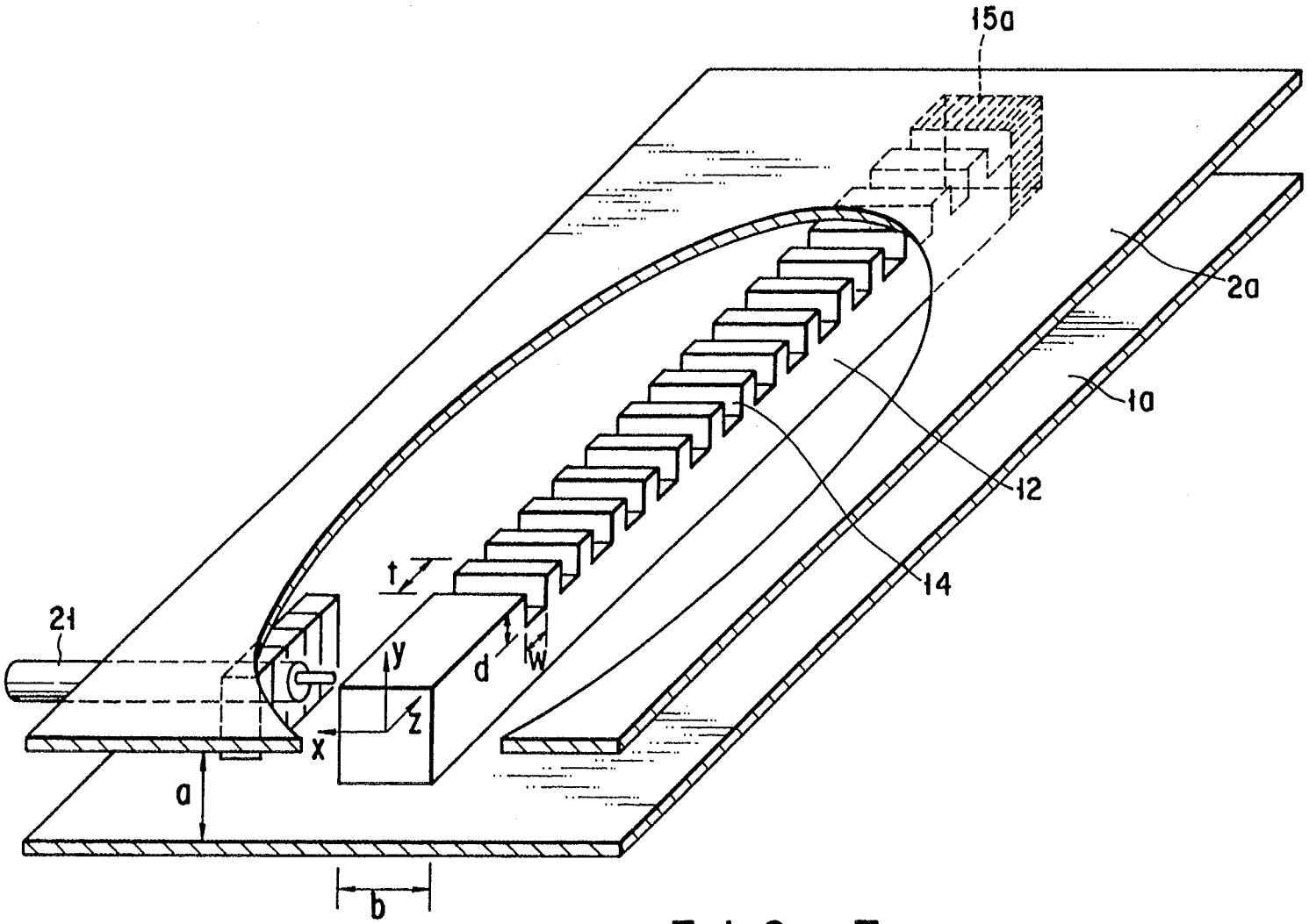
FIG. 7 is a perspective view of a leaky NRD waveguide constructed of a dielectric strip.
Figure 8:
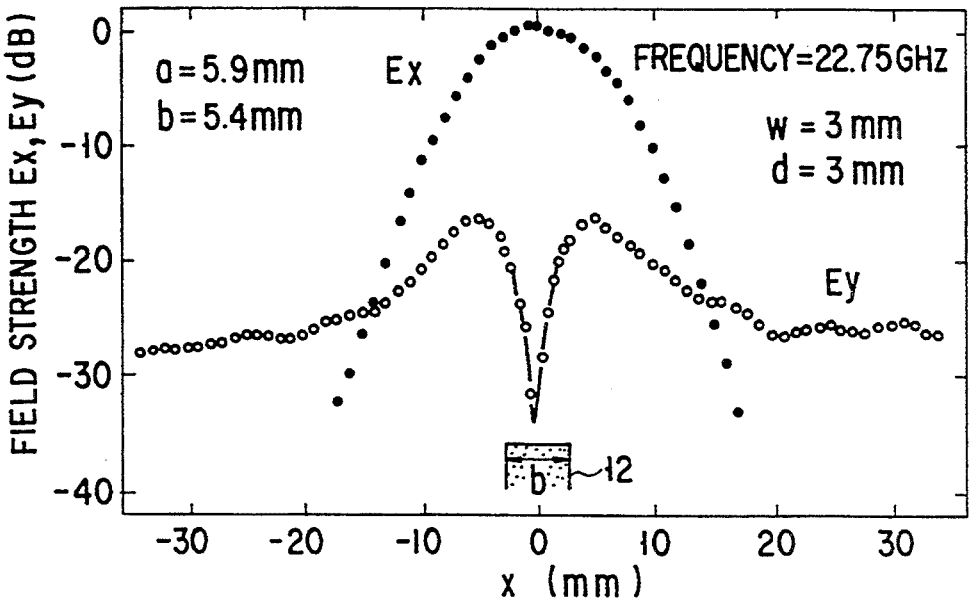
FIGS. 8 and 9 are the electrical characteristic diagrams for the FIG. 7 leaky NRD waveguide.

FIG. 8 shows the field strength distribution on both sides of the FIG. 7 dielectric strip 12. Here, the distance between the conductor plates 1*a* and 2*a* and the height a of the conductor strip 12 are 5.9 mm, the width of the conductor strip is 5.4 mm, the width of the cutouts 14 is 3 mm, its depth d is 3 mm, pitch of cutouts t are 6 mm and the frequency of the high-frequency power supplied is 22.75 GHz. In FIG. 8, white circles indicate the field strength Ex in the x direction, and black circuits represent the field strength Ey in the y direction. As apparent from the figure, there is a very highly symmetrical field strength distribution in the space between the conductor plates 1*a* and 2*a* on both sides of the dielectric strip 12. Therefore, by taking care not to ruin the symmetry of the field strength distribution, an antenna with an extremely accurate characteristic can be designed.

Figure 9:
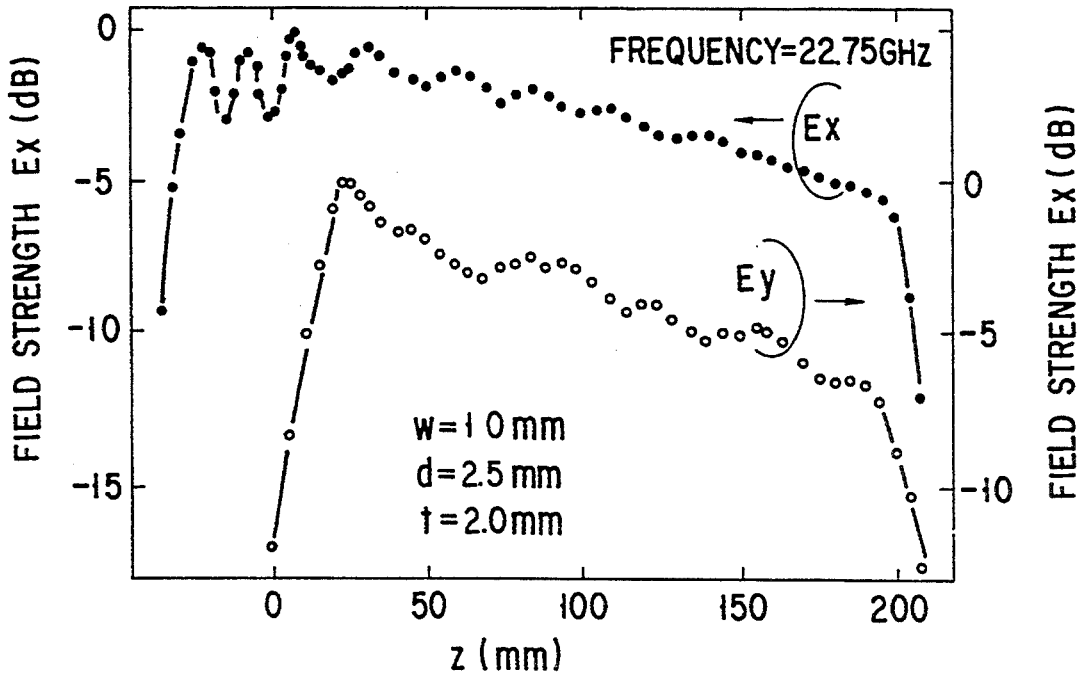

FIG. 9 shows the distribution of the field strength Ex and Ey along the dielectric strip 12. In this case, the point z=0 corresponds to the position of the outermost one of the multiple cutouts 14. Here, the cutouts 14 have a width w of 1 mm, a depth d of 2.5 mm, and an arrangement pitch t of 2 mm. As seen from FIG. 9, the field strength changes abruptly at portions 20 mm away from both ends of the cutout train, and attenuates in the central part. The degree of the attenuation is constant at approximately 30 dB/m.

Figure 10:
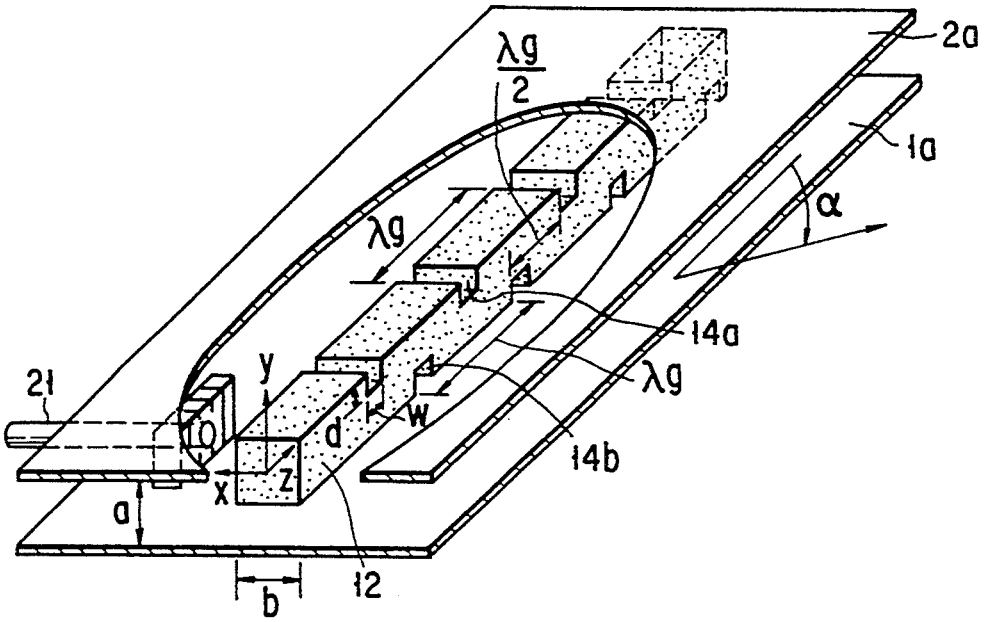
FIG. 10 is a perspective view of a leaky NRD waveguide of another construction.

Another mode of the leaky NRD waveguide will be explained, referring to FIGS. 10 through 13. This leaky NRD waveguide decreases the effect of the reflected wave from the end of the dielectric strip 12. FIG. 10 shows the construction of this leaky NRD waveguide. As shown in FIG. 7, to measure only the characteristic of the leaky NRD waveguide, a lower conductor plate 1*a* and an upper conductor plate 2*a* are provided which have a sufficiently large area and no slit in them.

The dielectric strip 12 has first cutouts 14*a* formed in its top face and second cutouts 14*b* formed in its bottom face. Those cutouts 14*a* and 14*b* are placed at regular intervals. The interval t is set equal to the wavelength λg of the high-frequency power transmitted over the leaky NRD waveguide. The first cutout 14*a* and the second cutout 14*b* are shifted λg/2 from each other, or half the wavelength.

Since a first radiation system composed of the first cutouts 14*a* is opposite to a second radiation system composed of the second cutouts 14*b* in terms of the vertical relationship, the electrical asymmetry at the first cutouts is opposite to that at the second cutouts, with the result that electromagnetic waves of opposite phases are radiated from those cutouts. Because the first cutouts 14*a* are shifted half the wavelength away from the second cutouts 14*b*, however, this shift reverses the phase of the radiated electromagnetic wave. Consequently, the electromagnetic wave radiated from the first radiation system composed of the first cutouts 14*a* is in phase with that from the second radiation system composed of the second cutouts 14*b*, with the result that electromagnetic waves are radiated which are in phase with each other along lines parallel with the dielectric strip 12. Therefore, even when there are reflected wave at the end of the dielectric strip 12, they have no effect on the electromagnetic wave radiated.

Figure 11:
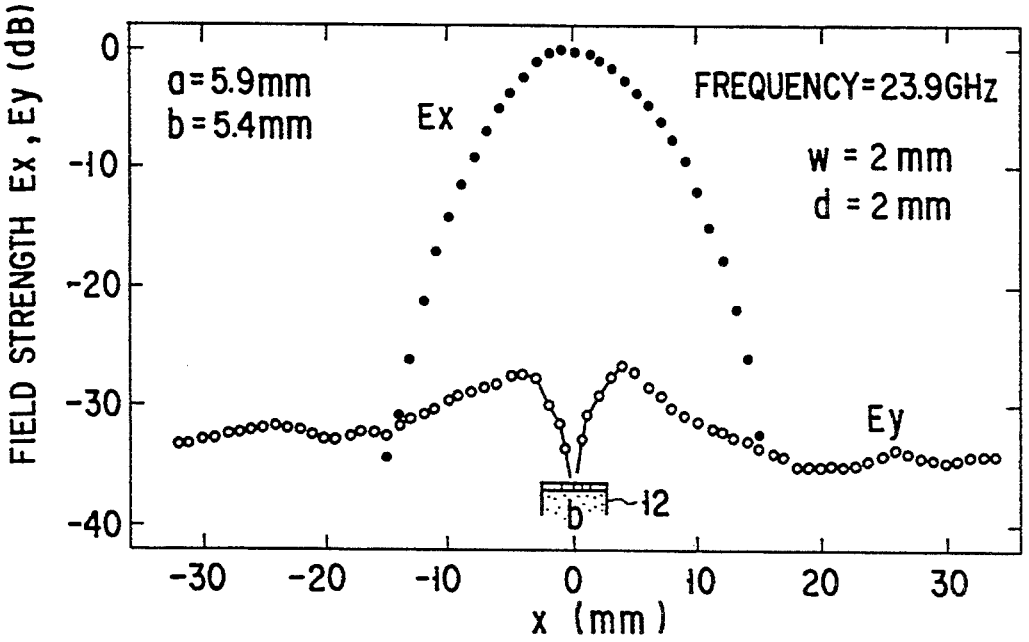
FIGS. 11 through 13 are the electrical characteristic diagrams for the FIG. 10 leaky NRD waveguide.
Figure 12:
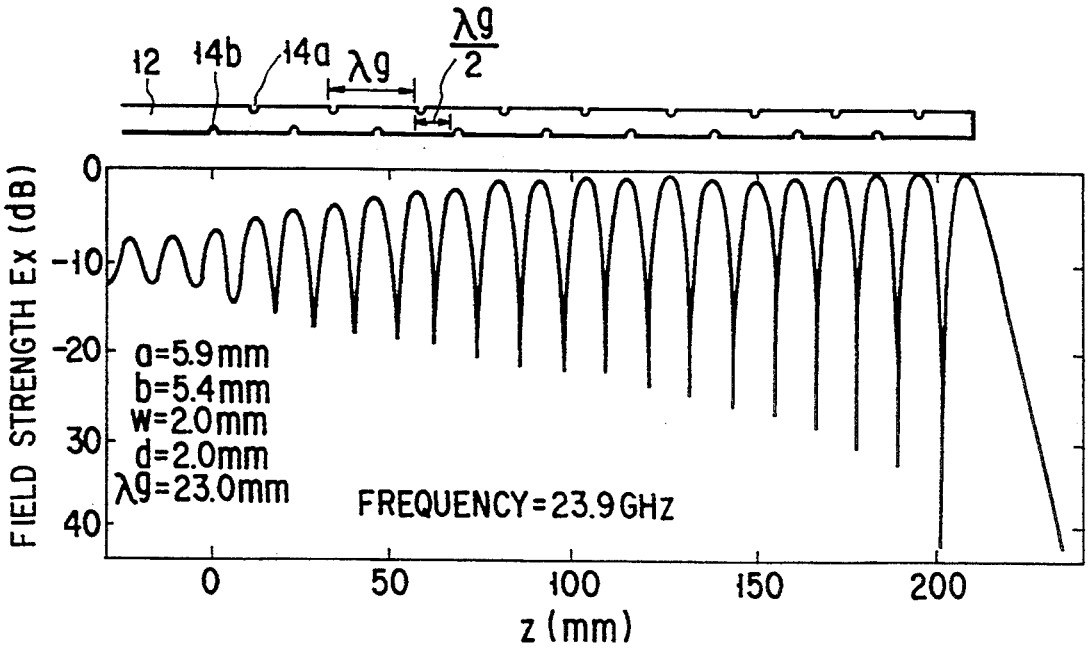
Figure 13:
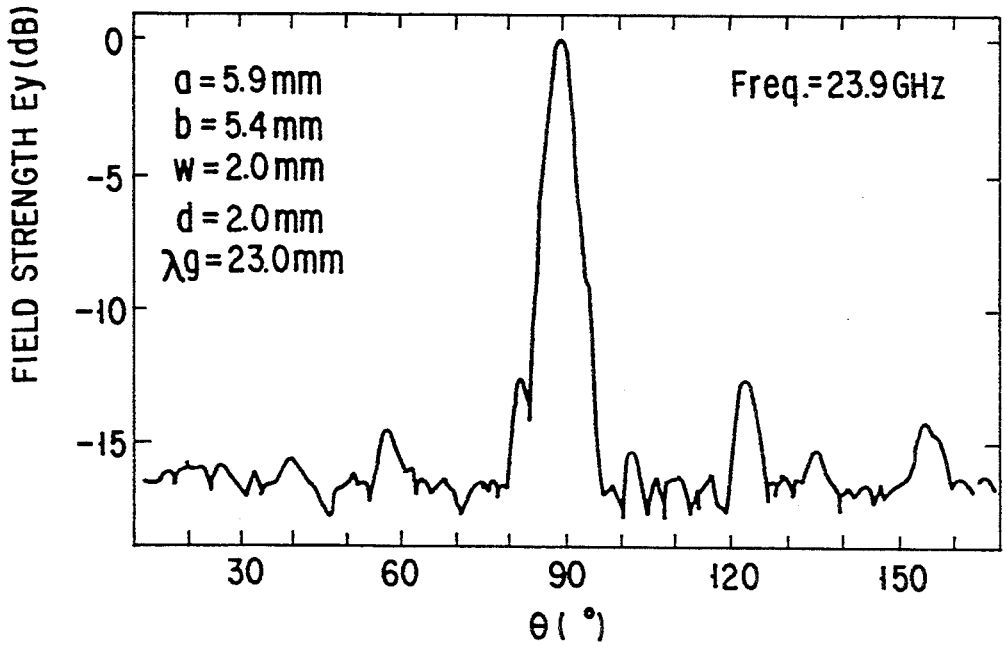

With such a leaky NRD waveguide, radiation is not affected by the reflected wave from its end and is free from grading lobes in the direction perpendicular to the dielectric strip 12. The results of testing the characteristics of the leaky NRD waveguide are shown in FIGS. 11 through 13. The specification of the leaky NRD waveguides used in the test is listed in each diagram.

FIG. 11 shows the distribution of field strength Ex and Ey in the x direction in FIG. 10. This the field strength distribution is same as FIG. 8.

FIG. 12 illustrates the distribution of field strength Ex in the z axis direction or along the axis of the dielectric strip 12. As seen from the figure, electromagnetic waves are radiated from each of the cutouts 14*a* and 14*b*, and the maximum value of the field strength Ex is almost constant at the very end of the dielectric strip 12.

FIG. 13 shows the result of testing the directional characteristic in the FIG. 10 x-z plane of the electromagnetic wave radiated from the ends of the lower conductor plate 1*a* and the upper conductor plate 2*a*. As obvious from the figure, the field strength becomes maximal at an angle α of approximately 90° in the x-z plane, having a sharp directivity in this direction. Because the level of the side lobes are suppressed to a very low value, no grading lobe occurs.

FIGS. 14 through 18 show the construction of still another mode of the leaky NRD waveguide. This waveguide has an improved radiation efficiency. If the distance between a pair of the conductor plates or the height of the dielectric strip is a, the width of the dielectric strip is b, the relative dielectric constant of material forming the dielectric strip is $\epsilon_r$, and the wavelength of the high-frequency power transmitted is λg, this leaky NRD waveguide will generally be designed to meet the following expressions:

$$a/\lambda \simeq 0.45$$

$$\sqrt{\epsilon_r - 1}\, b/\lambda g \simeq 0.4 \sim 0.6$$

As a material for the dielectric strips used under the above conditions, fluorine plastic, polyethylene plastic, polystyrene plastic, or the like are suitable. For example, Teflon has a relative dielectric constant $\epsilon_r$ of 2.04. The inside of the above-described cutout is a space filled with air, whose relative dielectric constant $\epsilon_{air}$ is approximately 1.0. Therefore, the difference in permittivity between the material of the dielectric strips and the air in the cutouts is small, which leads to a low degree of the asymmetry of the electrical asymmetric portion formed in the cutouts, with the result that the asymmetric portions produce less radiation. Consequently, the leaky NRD waveguide as shown in FIG. 10 produces insufficient radiation because the number of cutouts 14*a* and 14*b* is small.

Figure 14:
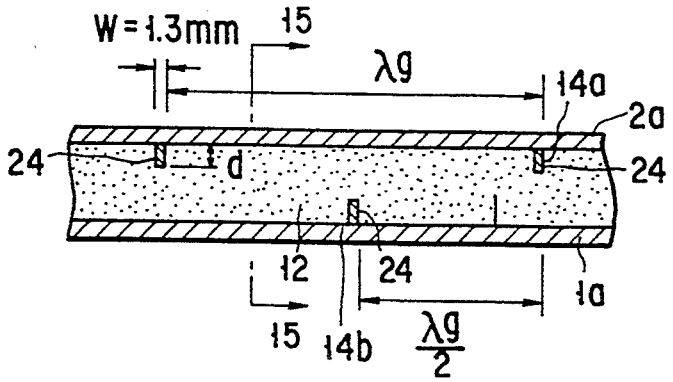
FIG. 14 is a vertical sectional view of another leaky NRD waveguide.
Figure 15:
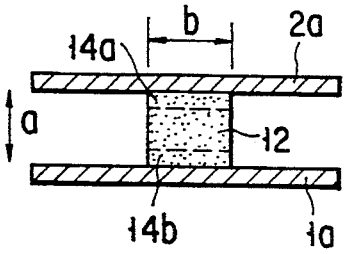
FIG. 15 is a sectional view taken along line 15—15 of FIG. 14.

Those shown in FIGS. 14 and 15 overcome this drawback. They have a material 24 whose permittivity is higher than that of the material for the dielectric strip 12 filled in the cutouts 14*a* and 14*b* in the dielectric strip 12. As the high permittivity material 24, a material whose permittivity is sufficiently high, such as a material commercialized under the trademark Dullold (relative dielectric constant: 10.2), is used. The leaky NRD waveguide shown in FIGS. 14 and 15 has the same construction as shown in FIG. 10 except for what has been described above. In this case, the height a of the dielectric strip 12 is 5.9 mm, the width b is 5.4 mm, and its material is Teflon. The width w of the cutouts is 1.3 mm. Because the cutouts 14*a* and 14*b* are filled with the high permittivity material 24, there is a great difference in permittivity between the filled material and the material for the dielectric strip 12, which makes the electrical asymmetry greater at the cutouts, resulting in a greater radiation.

Figure 16:
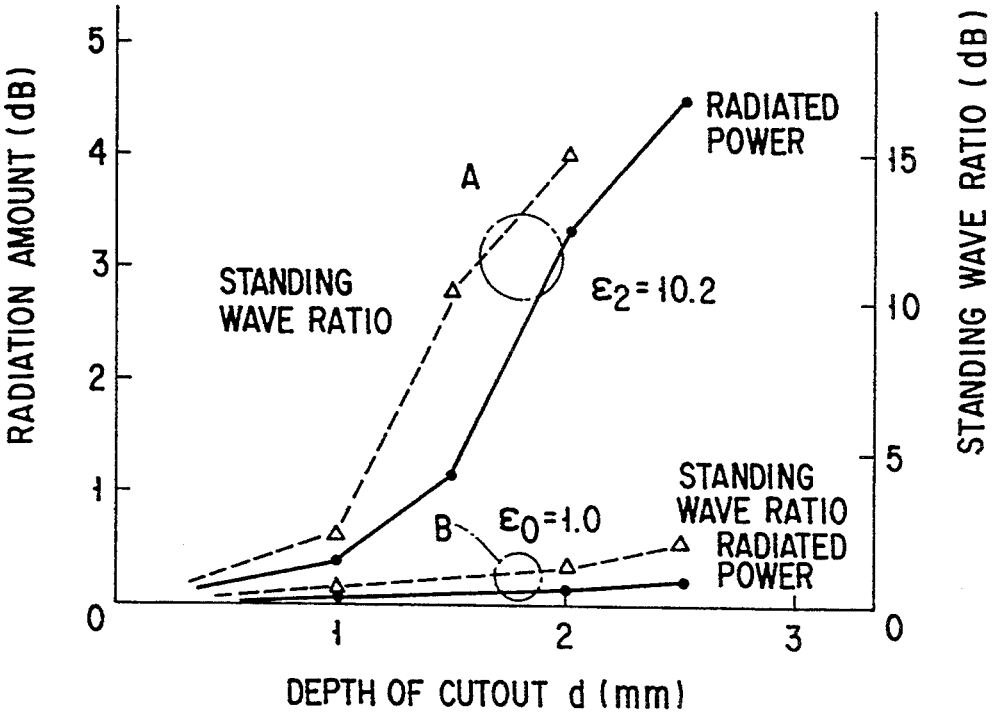
FIG. 16 is the electrical characteristic diagram for the FIG. 14 leaky NRD waveguide.

FIG. 16 shows the result of testing the characteristic of such a leaky NRD waveguide. In the test, various specimens in which the cutouts 14*a* and 14*b* had a different depth d were made, and their characteristics were measured. In FIG. 16, lines indicated by A show the characteristics when the high permittivity material 24 was filled in the cutout, whereas lines indicated by B show the characteristics when the high permittivity material is not filled in the cutout (instead, air whose relative dielectric constant is 1.0 exists). As seen from FIG. 16, both the standing wave ratio and the radiated power are increased remarkably when the high permittivity material 24 is filled in the cutouts 14*a* 10 and 14*b*.

Figure 17:
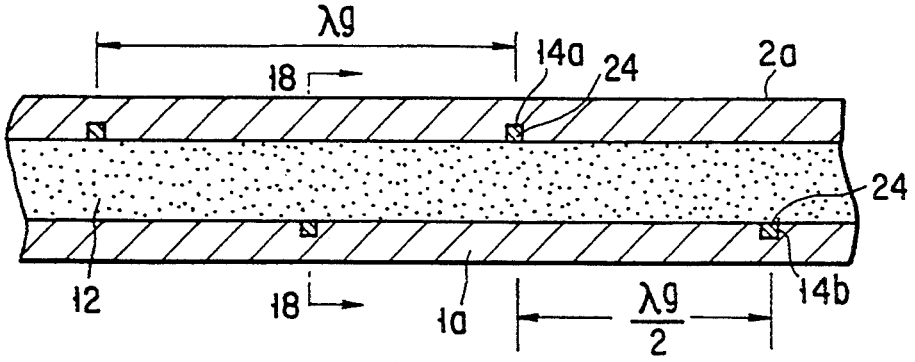
FIG. 17 is a vertical sectional view of another leaky NRD waveguide.
Figure 18:
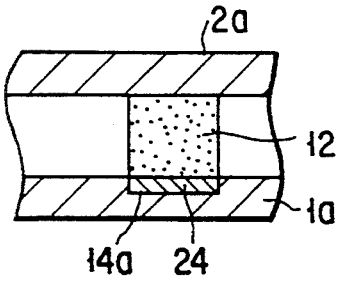
FIG. 18 is a sectional view taken along line 18—18 of FIG. 17.

FIGS. 17 and 18 show another mode of the leaky NRD waveguide where a high permittivity material is filled in the cutouts. In this waveguide, cutouts 14*a* and 14*b* are formed in the lower conductor plate 1*a* and the upper conductor plate 2*a* without forming cutouts in the dielectric strips 12, and a high permittivity material 24 is filled in the cutouts 14*a* and 14*b*. With such a leaky NRD waveguide, an electrical asymmetry occurs between the conductor plates 1*a* and 2*a* at those cutouts 14*a* and 14*b* and the high permittivity material 24, which enables electromagnetic waves to be radiated from those portions.

Figure 19:
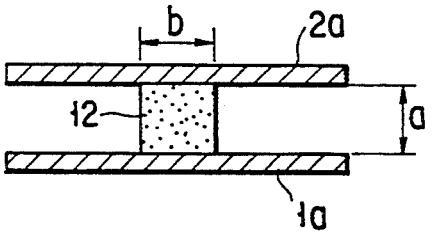
FIG. 19 is a transverse sectional view of another leaky NRD waveguide.
Figure 20:
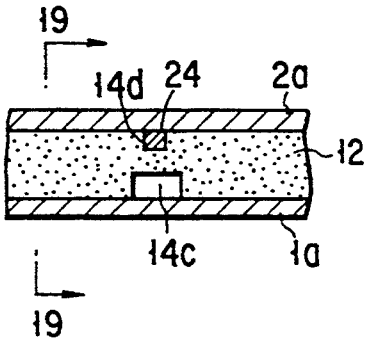
FIG. 20 is a vertical sectional view of the FIG. 19 leaky NRD waveguide.
Figure 21:
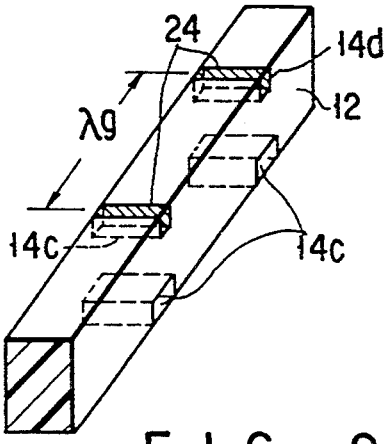
FIG. 21 is a perspective view of the dielectric strip of the FIG. 19 leaky NRD waveguide.

FIGS. 19 through 21 show another mode of the leaky NRD waveguide filled with the high permittivity material. In this waveguide, first cutouts 14*c* and second cutouts 14*d* are formed in the bottom face and the top face of the dielectric strip 12 in the same positions, and a high permittivity material 24 is filled in the second cutouts 14*d* in the top face. There is air in the first cutouts 14*c*. Pairs of cutouts 14*c* and 14*d* are arranged at intervals of a wavelength of λg as shown in FIG. 21.

In such a leaky NRD waveguide, the difference in permittivity between the fillers in the first cutout 14*c* and the second cutout 14*d* is great, a very great electrical asymmetry takes place at that portion. As a result, the radiation becomes great at that portion.

With this waveguide, the reflected waves in the axis direction in the dielectric strip 12 can be canceled. Specifically, the reflection mode at the first cutout 14*c* is such that the high-frequency power is reflected which is transmitted from the higher-permittivity material (the material for the dielectric strip) side at the interface between a higher permittivity material (a material for the dielectric strip) and a lower permittivity material (air). On the other hand, the reflection mode at the second cutout 14*d* is such that the high-frequency lower is reflected which is transmitted from the lower-permittivity material (the material for the dielectric strip) side at the interface between a lower permittivity material (a material for the dielectric strip) and a higher permittivity material (the high permittivity material 24). Therefore, the wave reflected from the first cutout 14*c* is shifted half the wavelength away from the wave reflected from the second cutout 14*d*. As a result, those reflected waves are canceled each other, thereby preventing the reflection in the axis direction in the dielectric strip 12.

Figure 22:
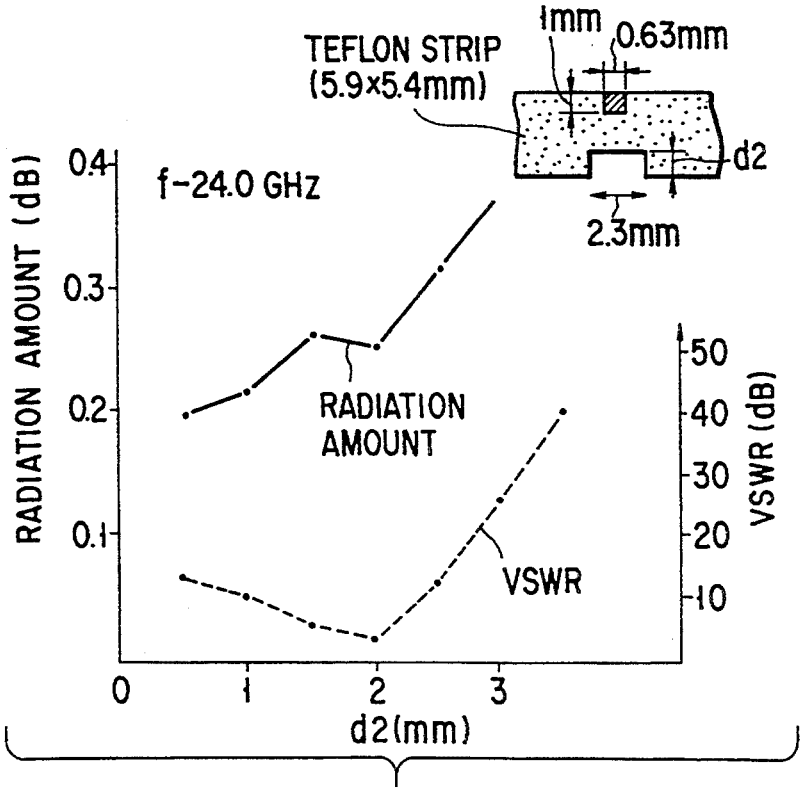
FIG. 22 is the electrical characteristic diagram for the FIG. 19 leaky NRD waveguide.

The result of testing the leaky NRD waveguide is shown in FIG. 22. In this test, to determine the conditions that allow the reflected wave from the first cutout to cancel out the reflected wave from the second cutout, the depth of the first cutout $d_2$ was varied for a dielectric strip with the dimensions as shown in FIG. 2. As apparent from the figure, the reflected waves are canceled at a point of $d_2 = 2$ mm, with the result that the standing wave ratio VSWR is 0.4 dB minimum. In this case, the radiation amount is 0.25 dB.

Figure 23:
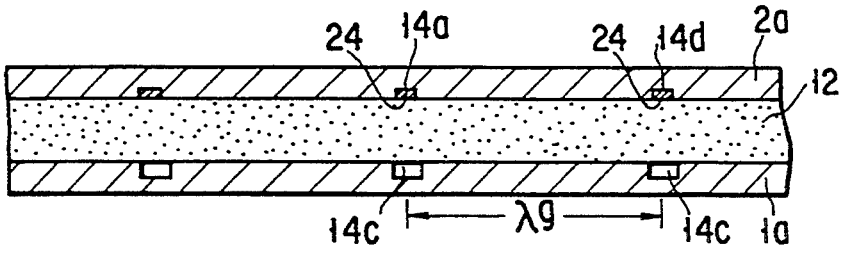
FIG. 23 is a vertical sectional view of another leaky NRD waveguide.
Figure 24:
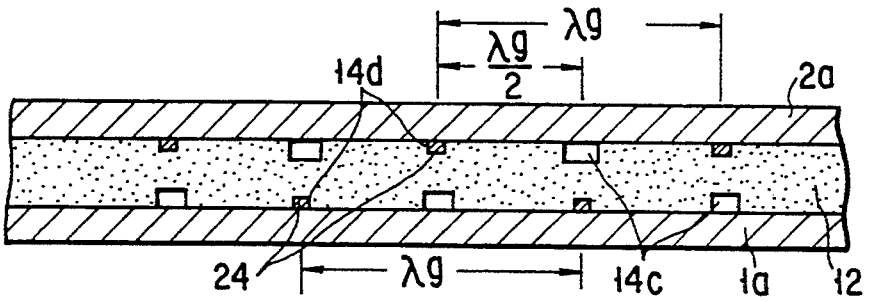
FIG. 24 is a vertical sectional view of another leaky NRD waveguide.
Figure 25:
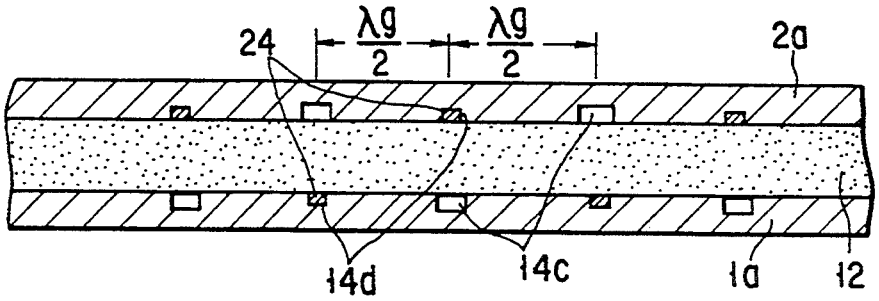
FIG. 25 is a vertical sectional view of another leaky NRD waveguide.
Figure 26:
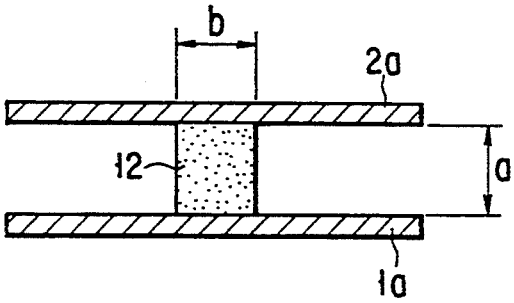
FIG. 26 is a transverse sectional view of another leaky NRD waveguide.

FIGS. 23 through 25 show another mode of the above leaky NRD waveguide.

In the waveguide of FIG. 23, first cutouts 14*c* are formed in the lower conductor plate 1*a*, second cutouts 14*d* are formed in the upper conductor plate 2*a*, and then a high permittivity material 24 is filled in the second cutouts 14*d*.

For the waveguide of FIG. 24, pairs of first cutouts 14*c* and second cutouts 14*d* are arranged over the dielectric strip 12 in such a manner that their top-bottom relationship is reversed alternately, and a high permittivity material 24 is filled in the second cutout 14*d*. In the waveguide of FIG. 25, the cutouts 14*c* and 14*d* are formed in the conductor plates 1*a* and 2*a*, and their arrangement is the same as shown in FIG. 24.

FIGS. 26 through 32 show another mode of the leaky NRD waveguide. With the waveguide, the reflected waves in the dielectric strip is prevented.

In this leaky NRD waveguide, as mentioned above, the dielectric strip 12 is placed between the lower conductor plate 1*a* and the upper conductor plate 2*a*. Radiation cutouts 14*a* are formed in the top face or the bottom face of the dielectric strip 12. A pair of reflection cutouts 25 is formed a wavelength of λg/4 in front of the radiation cutout 14*a*, that is, on the high-frequency power supplying side. Those reflection cutouts 25, whose dimensions and shape are the same, are formed in the top and bottom faces in the same position. Therefore, the cross-sectional shape of the dielectric strip 12 keeps the vertical symmetry at those reflection cutouts 25.

With this waveguide, high-frequency power is radiated from the radiation cutouts 14*a*. At the radiation cutouts 14*a*, reflected waves are formed in the dielectric strip 12 in its axis direction. Since at the reflection cutouts 25, the dielectric strip 12 is vertically symmetric, electromagnetic waves are not radiated, but reflected at the reflection cutouts 25 in the axis direction in the dielectric strip 12. Because the wave reflected from the radiation cutout 14*a* makes a round trip over a distance of λg/4 before reaching the reflection cutouts 25, it is shifted λg/2 or half the wavelength away from the reflected wave from the reflection cutouts 25. Consequently, the reflected wave from the radiation cutout 14*a* cancels the reflected wave from the reflection cutout 25, with the result that there is no reflected wave in the dielectric strip 12.

Figure 27:
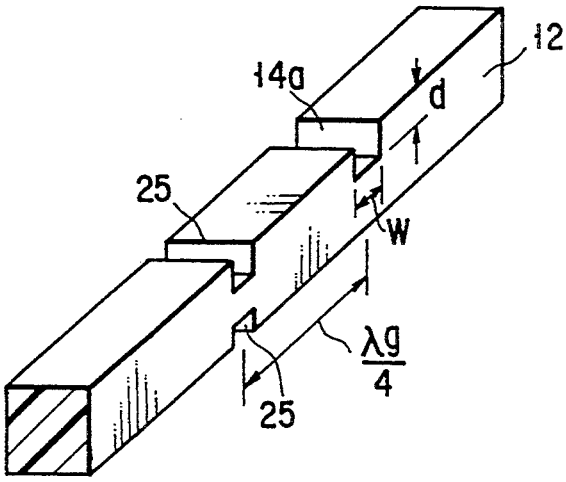
FIG. 27 is a perspective view of the FIG. 26 dielectric strip.

As shown in FIG. 27, to obtain the characteristic of the leaky NRD waveguide, the following test was conducted. In the test, the frequency of the high-frequency power was 24 G Hz, and the material for the dielectric strip 12 having a height a of 5.9 mm and a width w of 5.4 mm was Teflon. For the radiation cutout 14*a* having a depth d of 2.5 mm and a width of 2.5 mm, the power reflection coefficient A of a single radiation cutout 14*a* was 4.2% and its reflection phase Φ was 0.37. Here, the Φ was assumed to be $\Phi = 1/\lambda g$ when the distance from the position of the bottom of a standing wave formed by the travelling wave transmitted through the dielectric strip and the reflected wave at the radiation recessed portion 14*a* to the position of the reflection cutout 25 was considered to be 1.

Figure 28:
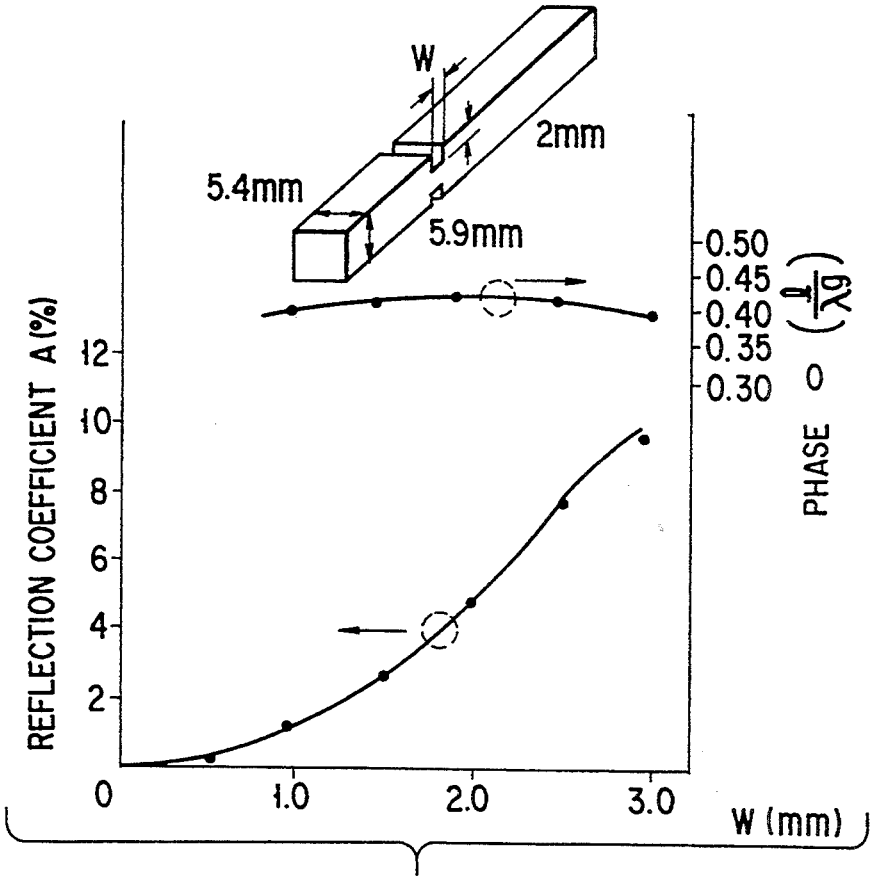
FIGS. 28 and 29 are the electrical characteristic diagrams for the FIG. 26 leaky NRD waveguide.

Changes in the reflection coefficient A and the reflection phase Φ as the width w of the reflection CutOut 25 having a depth d of 2 mm varies are shown in FIG. 28. The reflection coefficient is zero for the width w=0, and increases with the increase of the width w. When the width w=2 mm, the reflection coefficient of the reflection cutout 25 becomes equal to the reflection coefficient of the reflection cutout 14*a*. At this time, the reflection coefficient is A=4.4% and the reflection phase is Φ=0.48.

Figure 29:
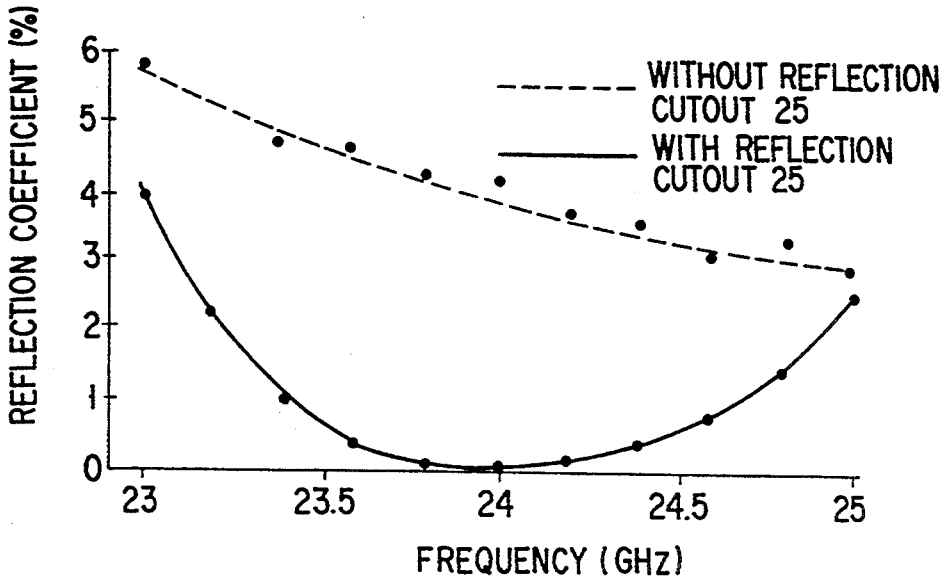
Figure 30:
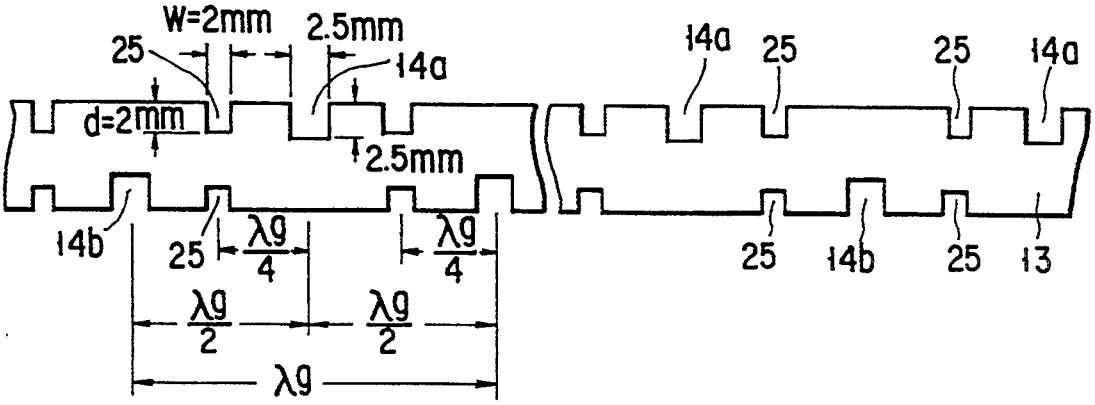
FIG. 30 is a side view of the entire dielectric strip of FIG. 27.

FIG. 29 shows the frequency characteristic of the dielectric strip 12. As seen from the figure, when the above reflection cutout 25*s* are formed, the overall reflection coefficient can be controlled to a very low level over a very wide frequency band near 24 GHz.

Figure 32:
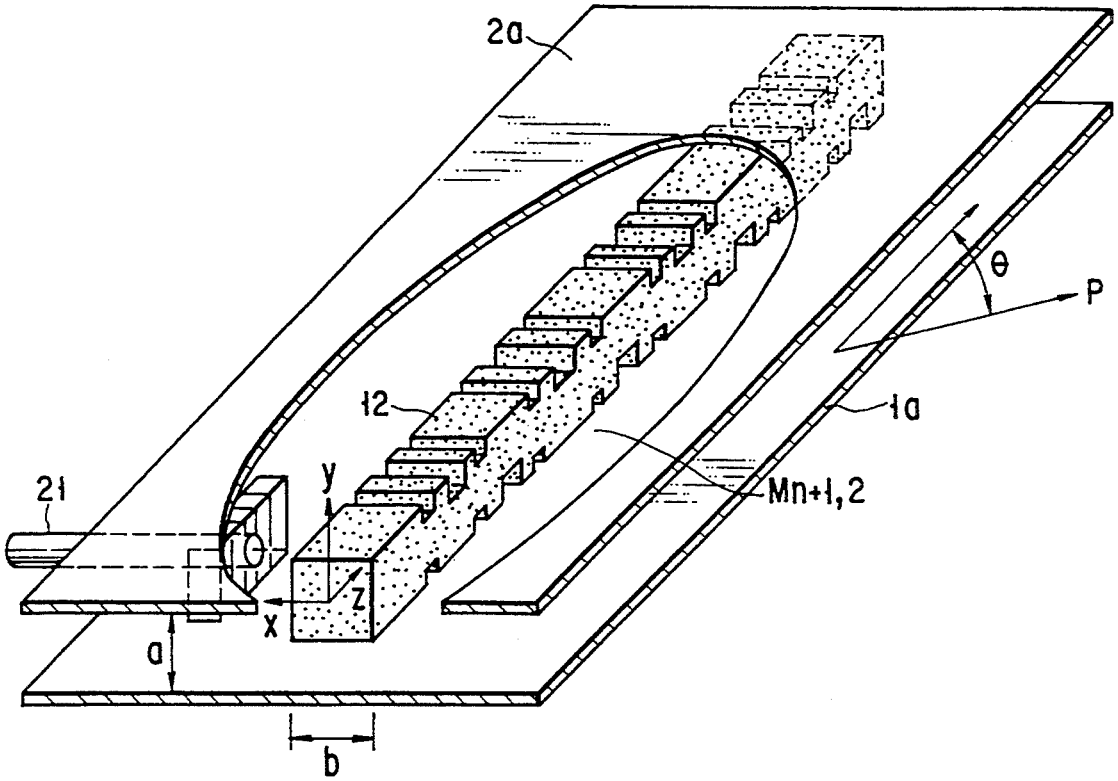
FIG. 32 is a perspective view of another leaky NRD waveguide.

For a practical dielectric strip 12, the above radiation cutouts 14*a* and pairs of reflection cutouts 25 are provided. The arrangement of the radiation cutouts 14*a* and 14*b* is the same as that for the dielectric strip 12 shown in FIG. 10. Such a dielectric strip 12 is placed between the lower conductor plate 1*a* and the upper conductor plate 2*a* as shown in FIG. 32 and powered by a coaxial line 21 or the like.

Figure 31:
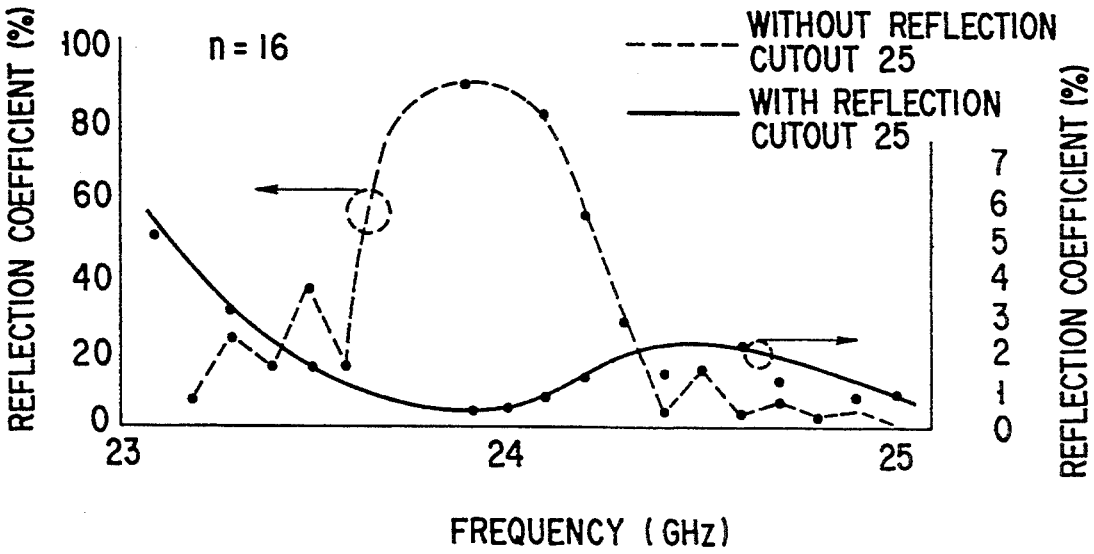
FIG. 31 is the electrical characteristic diagram for the FIG. 30 dielectric strip.

FIG. 31 shows the characteristic of such a leaky NRD waveguide. In this waveguide, 16 radiation cutouts and 16 pairs of reflection cutouts are arranged. As obvious from the figure, with this leaky NRD waveguide, the reflection coefficient is suppressed as low as approximately A=1% at a frequency band ranging from 23 to 25 GHZ. In contrast, when no reflection cutout is not formed, the reflection coefficient in the same frequency band is A=95%.

Figure 33:
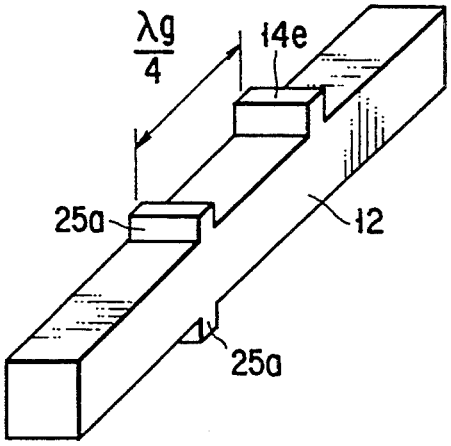
FIG. 33 is a perspective view of another dielectric strip.

FIG. 33 shows another mode of the dielectric strip in which such reflection portions are formed. In this waveguide, a reflection projecting portions 25*a* are formed in place of the reflection cutouts, and radiation projecting portions 14*e* are formed in place of the radiation cutouts.

Figure 34:
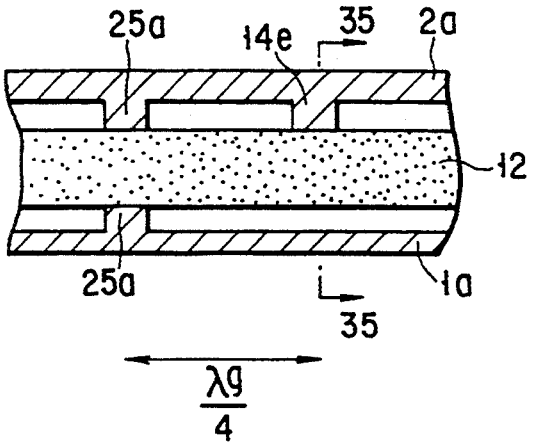
FIG. 34 is a vertical sectional view of another leaky NRD waveguide.
Figure 35:
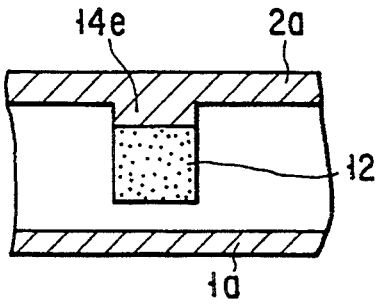
FIG. 35 is a sectional view taken along line 35—35 of FIG. 34.

In those shown in FIGS. 34 and 35, instead of forming the reflection projecting portions and radiation projecting portions in the dielectric strip 12, reflection projecting portions 25*a* and radiation projecting portions 14*e* are formed in the conductor plates 1*a* and 2*a*.

Figure 36:
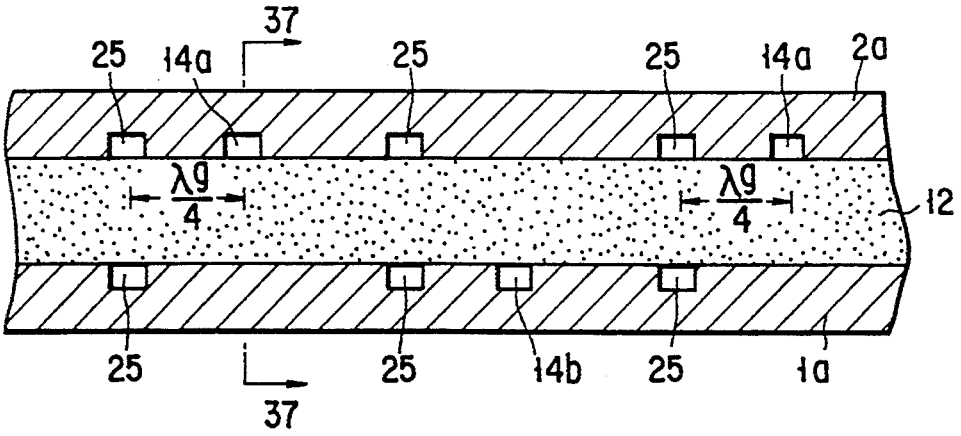
FIG. 36 is a perspective view of another leaky NRD waveguide.
Figure 37:
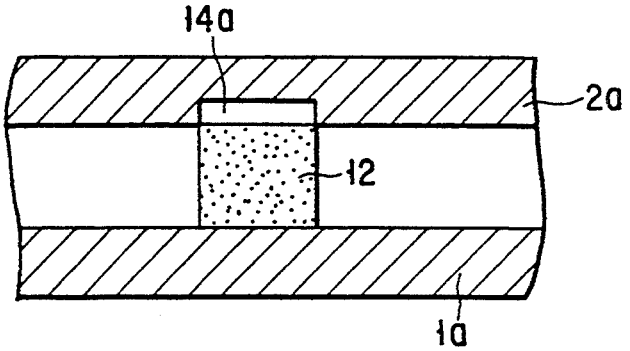
FIG. 37 is a sectional view taken along line 37—37 of FIG. 36.

In those shown in FIGS. 36 and 37, instead of forming the reflection cutouts 25 and the radiation cutouts 14*a* and 14*b* in the dielectric strip 12, the reflection cutouts 25 and the radiation cutouts 14*a* and 14*b* are formed in the conductor plates 1*a* and 2*a*.

FIGS. 38 through 42 show another mode of the leaky NRD waveguide. With this waveguide, radiation is produced only one side of the dielectric strip.

Figure 38:
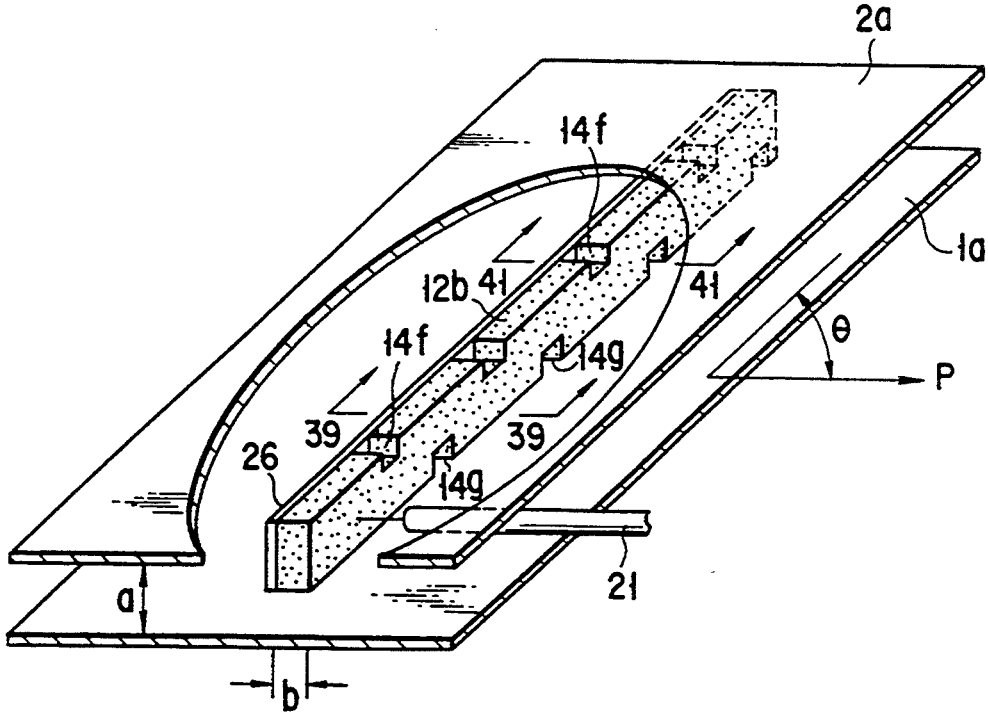
FIG. 38 is a vertical sectional view of another leaky NRD waveguide.
Figure 39:
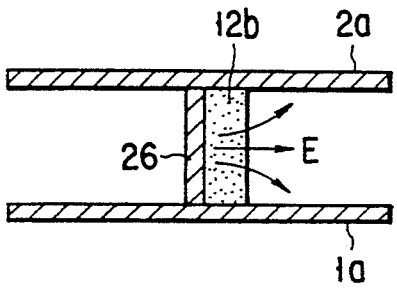
FIG. 39 is a sectional view taken along line 39—39 of FIG. 38.

In the leaky NRD waveguide, as shown in FIG. 38, a dielectric strip 12*b* is placed between the lower conductor plate 1*a* and the upper conductor plate 2*a*. Only along one side of the conductor strip 12*b*, a conductor plate or an image plate 26 is placed. In the top face and the bottom face of the dielectric strip 12*b*, cutouts 14*g* and 14*f* are formed alternately as mentioned with the dielectric strip 12 of FIG. 10. This leaky NRD waveguide allows electromagnetic waves to radiate only toward the right side of FIG. 38, and prevents electromagnetic waves from being radiated toward the opposite side.

If the distance between the conductor plates 1*a* and 2*a* or the height of the dielectric strip 12*b* is a, the width of the dielectric strip 12*b* is b, and the permittivity of the material for the dielectric strip 12*b* is $\epsilon r$, the dimensions of the leaky NRD waveguide are set to meet the following equations:

$$a/\lambda g \simeq 0.45$$

-continued $$\sqrt{\epsilon_r - 1b/\lambda g} \simeq 0.2 \sim 0.3$$

Namely, the width of the dielectric strip 12*b* is half the width of the dielectric strip without the image plate 26.

Figure 40:
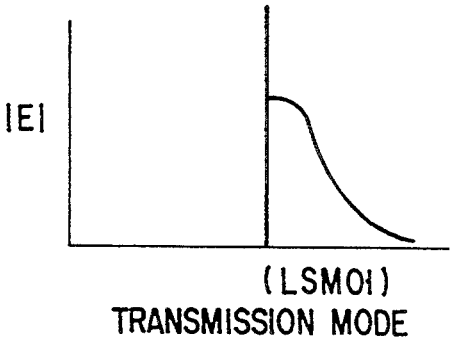
FIG. 40 is the characteristic diagram for the portion of FIG. 39.
Figure 41:
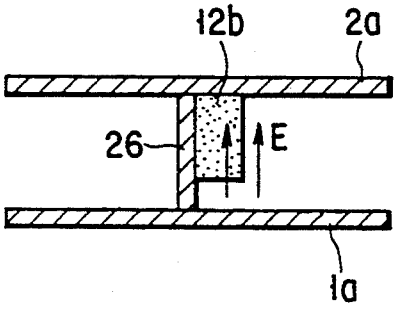
FIG. 41 is a sectional view taken along line 41—41 of FIG. 38.

The image plate 26 is placed in a position where the electric field becomes maximal when the high-frequency power is transmitted in the dielectric strip 12*b*. Thus, as shown in FIG. 40, at portions without cutouts 14*f* and 14*g*, the electric field develops only on one side in the direction perpendicular to the image plate 26. This state is the dominant transmission mode ($LSM_{01}$). From those portions, electromagnetic waves will not be radiated.

Figure 42:
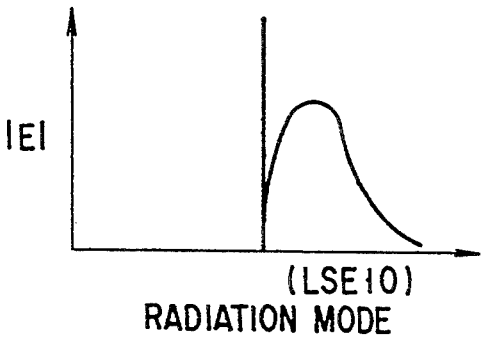
FIG. 42 is the electrical characteristic diagram for the portion of FIG. 41.

At portions where the cutouts 14*f* and 14*g* are formed, the electric field takes the form as shown in FIG. 42. This state is the radiation mode ($LSM_{10}$). Those portions allows electromagnetic waves to be radiated only on one side, or in the opposite direction to the image plate 26.

Figure 43:
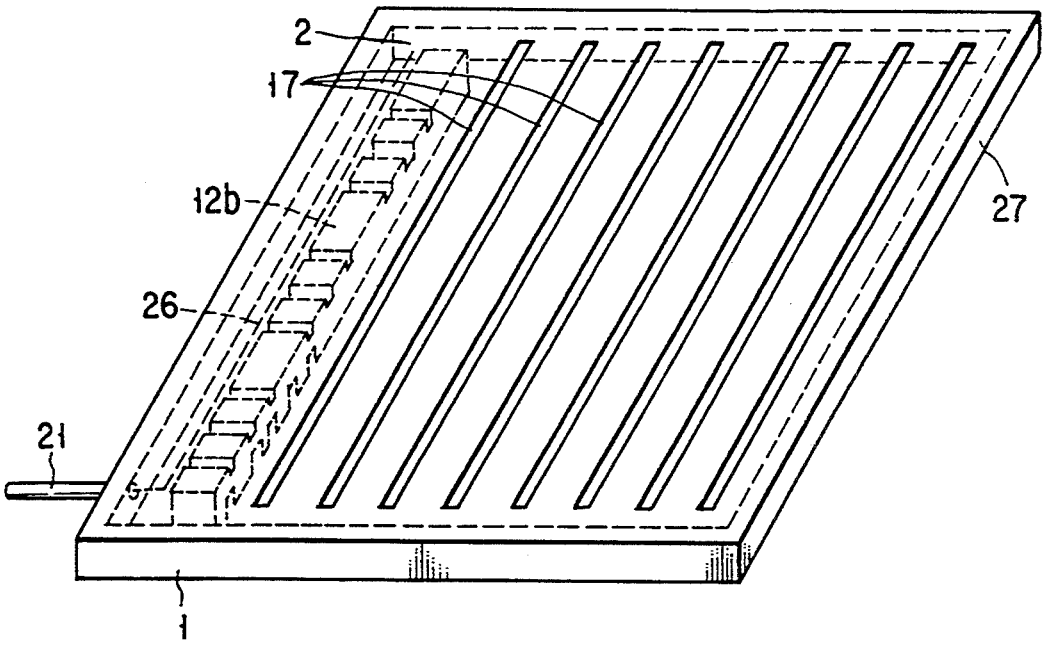
FIG. 43 is a perspective view of another plane antenna.

Such a leaky NRD waveguide is used for a plane antenna as shown in FIG. 43, for example. The plane antenna is provided with a lower conductor plate 1 and an upper conductor plate 2. Near one end of the space between the conductor plates 1 and 2, a dielectric strip 12*b* as described above and an image plate 26 are placed. The dielectric strip 12*b* is supplied with high-frequency power via a coaxial line 21. At the other end of the conductor plates 1 and 2, a reflection wall 27 is provided. The reflection wall 27 is parallel with the above dielectric strip 12*b*. Radiation slots 17 are formed in the upper conductor 2 at regular intervals so as to be parallel with each other.

With this waveguide, the dielectric stripe 12*b* radiates electromagnetic waves into the space between the conductor plates 1 and 2. The radiated electromagnetic wave is reflected by the reflection wall 27, with the result that a standing wave is formed in the space between the conductor plates 1 and 2 between the reflection wall 27 and the dielectric strip 12*b*. The standing wave then excites the radiation slots 17 to radiate electromagnetic waves in the direction perpendicular to the conductor plates 1 and 2.

In this case, since the image plate 26 is placed on the side of the dielectric strip 12*b*, the dielectric strip 12*b* radiates electromagnetic waves only toward the reflection wall 27, not in the opposite direction. Therefore, the electromagnetic waves radiated will not interfere with each other, resulting in a high efficiency.

Figure 44:
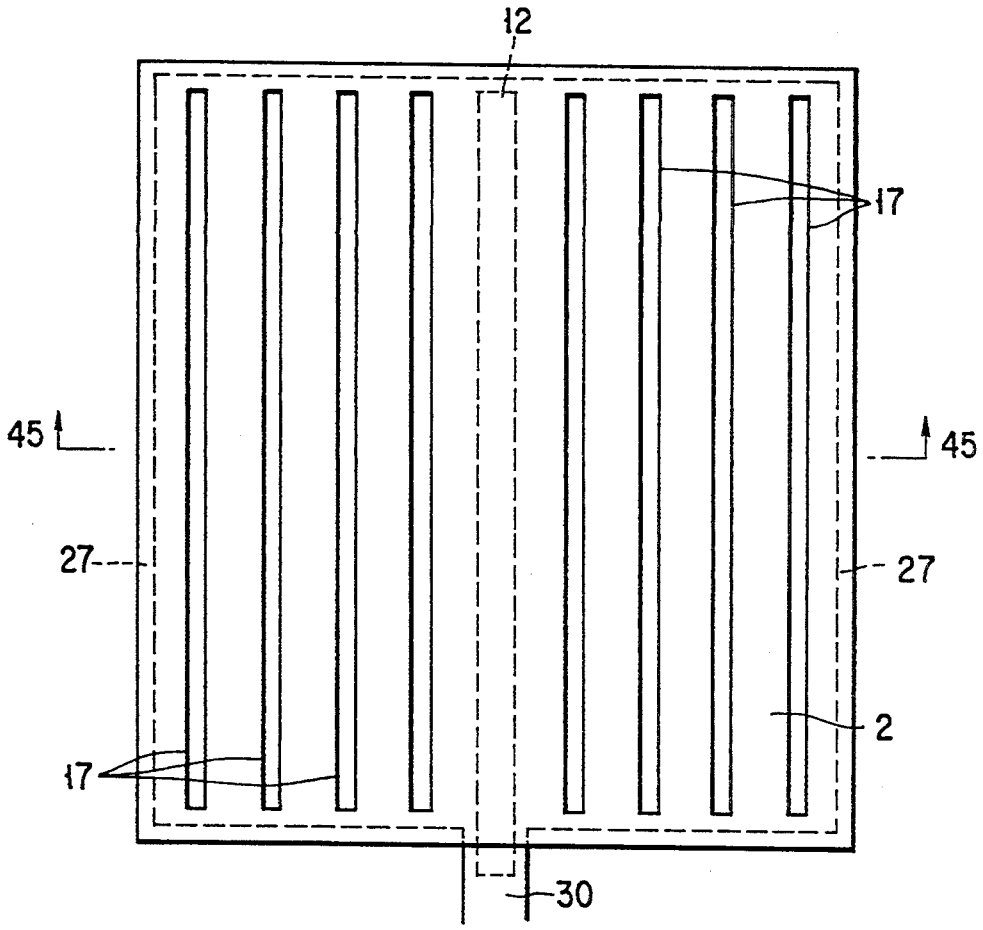
FIG. 44 is a plan view of another plane antenna.
Figure 45:
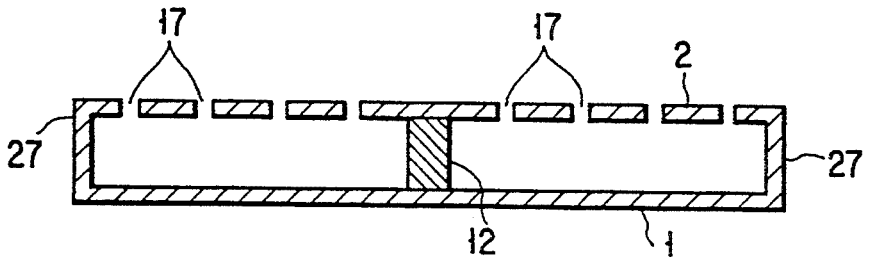
FIG. 45 is a sectional view taken along line 45—45 of FIG. 44.

There are various modes of plane antennas using the above leaky NRD waveguide. For example, FIGS. 44 and 45 show another mode of a plane antenna. In this antenna, a single dielectric strip 12 is placed in the middle of the lower conductor plate 1 and the upper conductor plate 2. On both ends of the conductor plates 1 and 2, reflection walls 27 are formed. In the upper conductor plate 2, radiation slots 17 are formed at regular intervals. The dielectric strip 12 is powered by a waveguide 30.

With this waveguide, electromagnetic waves are radiated on both sides of the dielectric strip 12, and the radiated electromagnetic waves are reflected by the reflection walls 27. Standing waves are formed in the space between the conductor plates 1 and 2 on both sides of the dielectric strip 12. The standing waves excite the radiation slots 17 to radiate electromagnetic waves in the direction perpendicular to the conductor plate 2.

Figure 46:
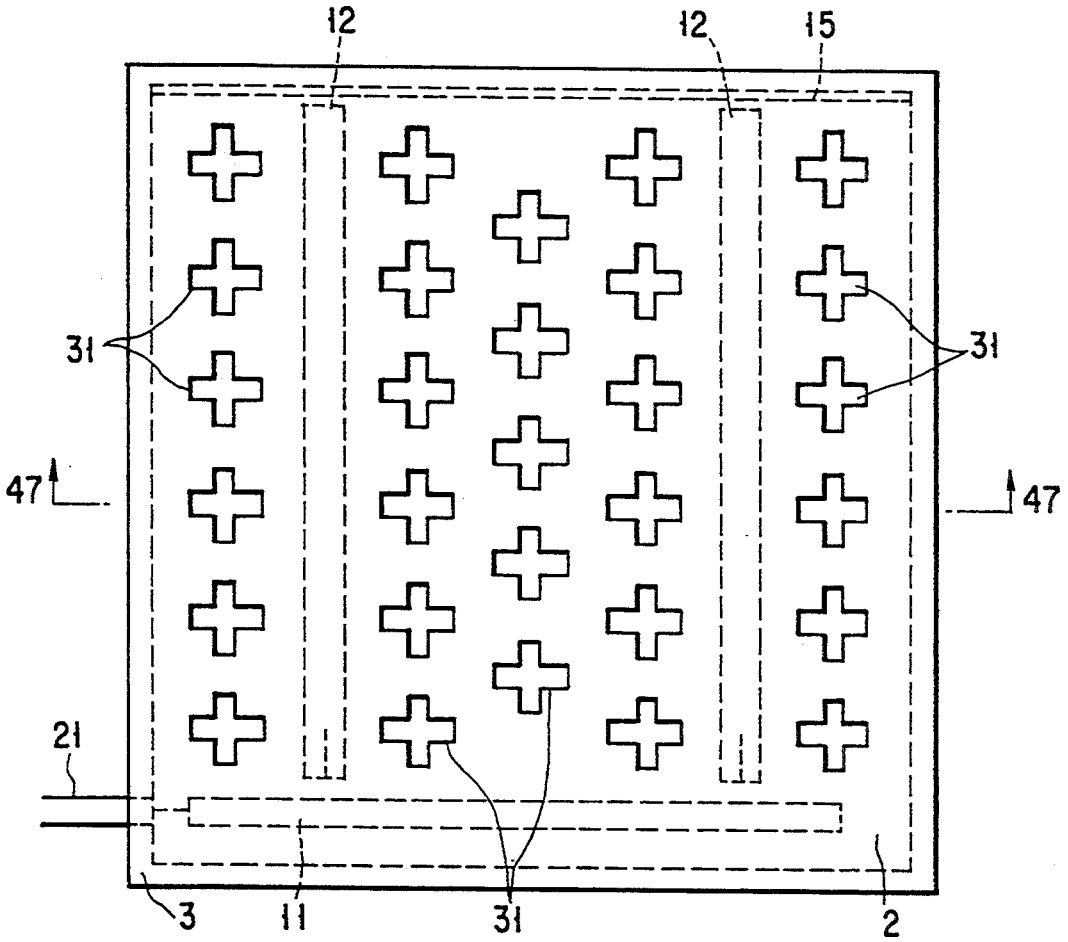
FIG. 46 is a plan view of another plane antenna.
Figure 47:
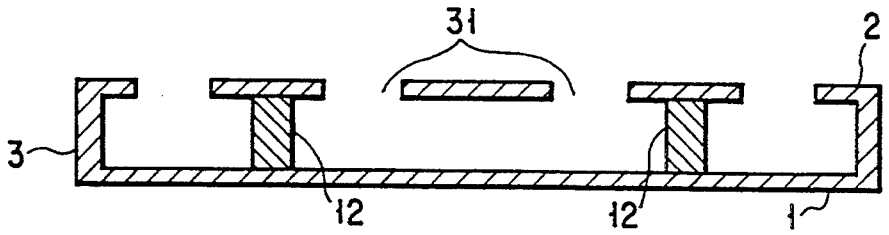
FIG. 47 is a sectional view taken along line 47—47 of FIG. 46.

FIGS. 46 and 47 show another plane antenna for circularly polarized wave. In this antenna, two dielectric strips 12 are placed between a lower conductor plate 1 and an upper conductor plate 2. A power-supply dielectric strip 11 supplies power to the dielectric strips 12.

In the upper conductor plate 2, cross-shaped slots 31 are formed at specified intervals.

With this antenna, the dielectric strips 12 radiate electromagnetic waves into the space between the conductor plates 1 and 2. The radiated electromagnetic waves excite the cross-shaped slots 31, which then radiate circularly polarized electromagnetic waves.

Figure 48:
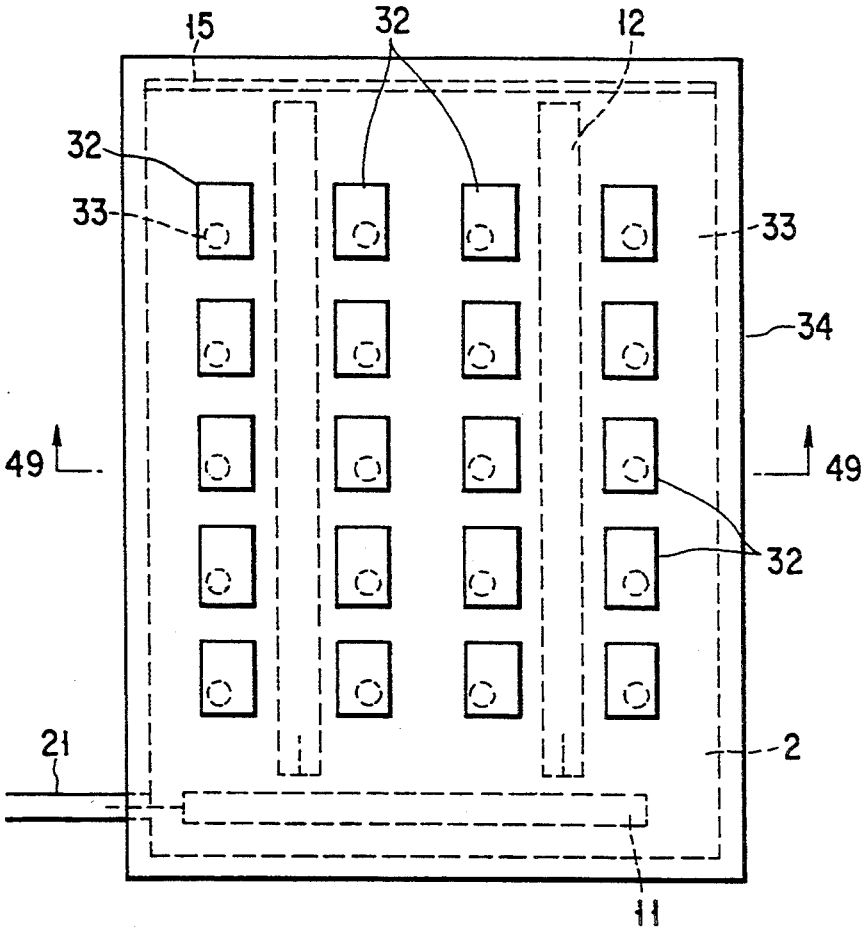
FIG. 48 is a plan view of another plane antenna.
Figure 49:
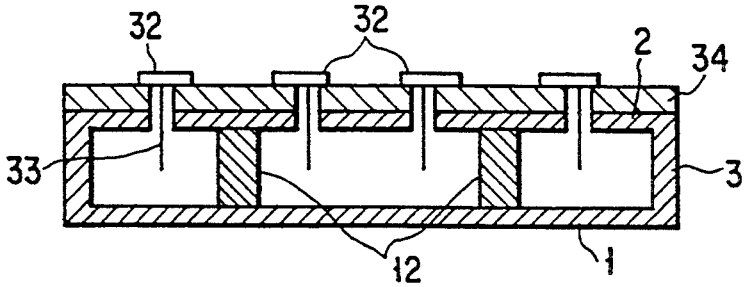
FIG. 49 is a sectional view taken along line 49—49 of FIG. 48.

FIGS. 48 and 49 show another antenna. In this antenna, holes are made at specified intervals in the upper conductor plate 2, on which a printed board 34 is placed. Patch antennas 32 (microstrip antennas) are formed on the printed board 34 at specified intervals. Probes 33 are provided so as to project from each patch antenna 32. The probes 33 pass through the holes in the upper conductor plate 2 to reach and connect to the space between the conductor plates 1 and 2. This embodiment has the same construction as that of FIGS. 46 and 47 except for the above construction.

With this antenna, the dielectric strips 12 radiate electromagnetic waves into the space between the conductor plates 1 and 2. This excites the patch antennas 32, which radiate circularly polarized waves.

An antenna using the above leaky NRD waveguide is not limited to the plane antennas mentioned above, but may be constructed in various types.

Figure 50:
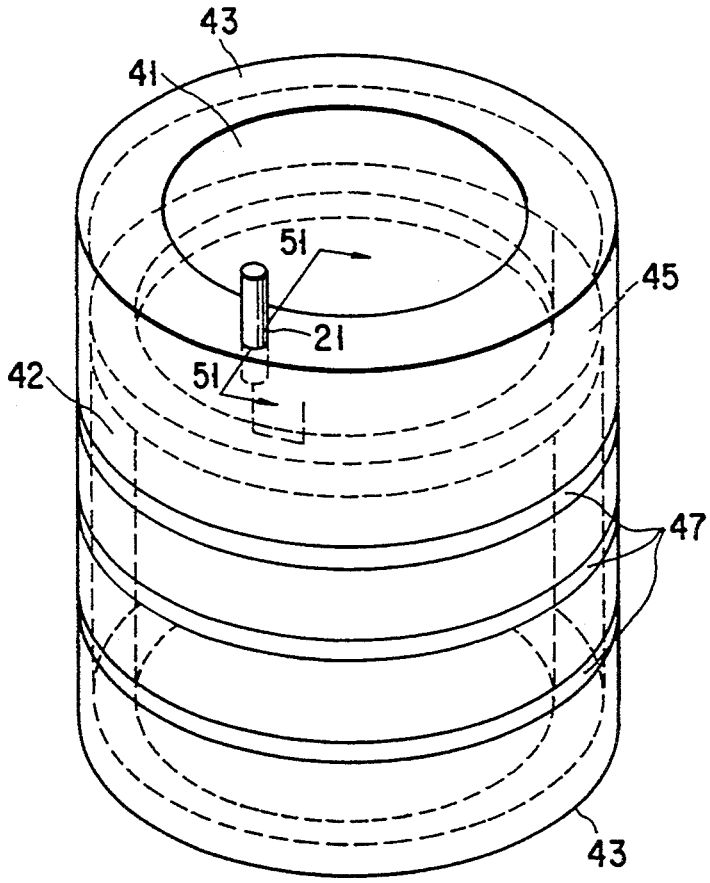
FIG. 50 is a perspective view of another plane antenna.
Figure 51:
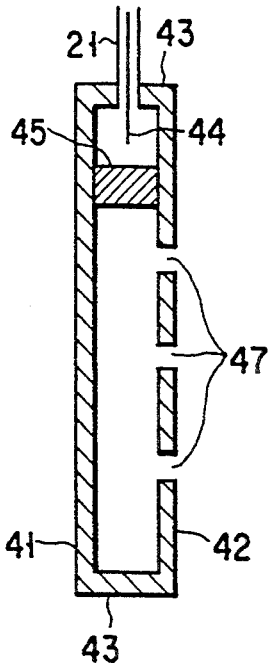
FIG. 51 is a sectional view taken along line 51—51 of FIG. 50.

For example, FIGS. 50 and 51 show a cylindrical antenna. This antenna is provided with a cylindrical inner conductor plate 41 and a cylindrical outer conductor plate 42, which are placed concentrically. The diameter of the outer conductor plate 42 is larger than that of the inner conductor plate 41. As a result, a cylindrical space is formed between the cylindrical conductor plates 41 and 42. On the top and bottom ends of the conductor plates 41 and 42, walls 43 are formed to close the cylindrical space.

A cylindrical dielectric strip 45 is placed in the upper portion of the space between the conductor plates 41 and 42. As mentioned above, the dielectric strip 45, whose cross section is rectangular, has electrically asymmetric portions, such as cutouts, formed in it at regular intervals. Power is supplied to the dielectric strip 45 from a central conductor 44 of a coaxial line 21.

Cylindrical radiation slots 47 are formed in the outer conductor plate 42 along the circumference. Those radiation slots 47 are arranged at specified intervals in the axis direction.

With such an antenna, the dielectric strip 45 radiates electromagnetic waves into the space between the conductor plates 41 and 42. The electromagnetic wave excites the radiation slots 47, which then radiate electromagnetic waves uniformly in every direction along the circumference.

Figure 52:
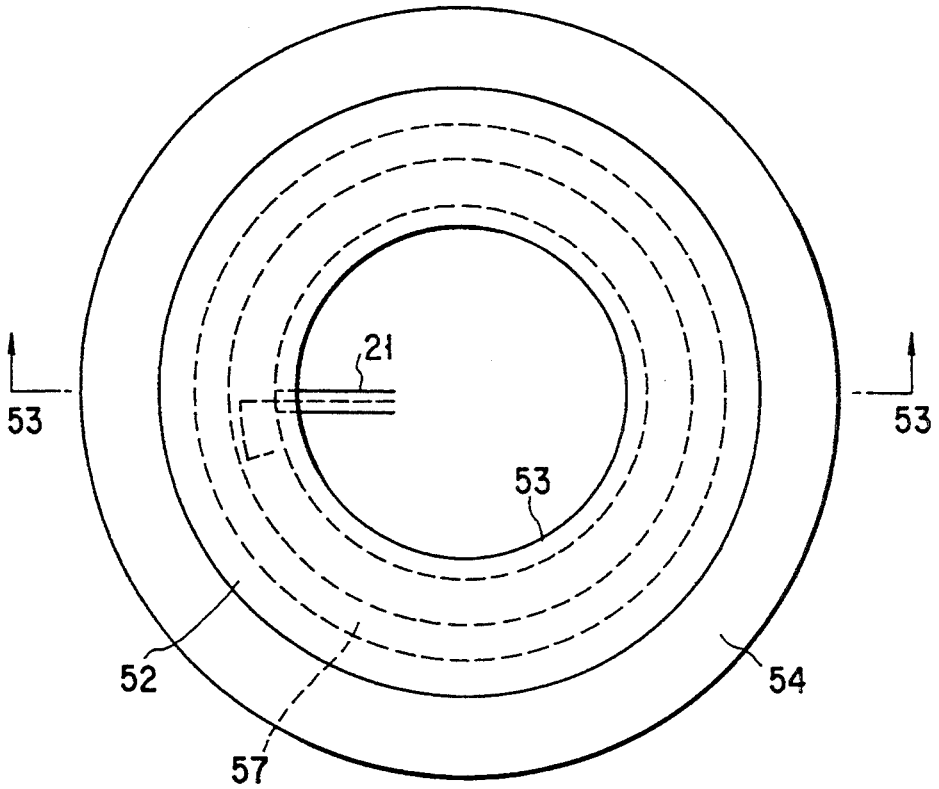
FIG. 52 is a plan view of another plane antenna.
Figure 53:
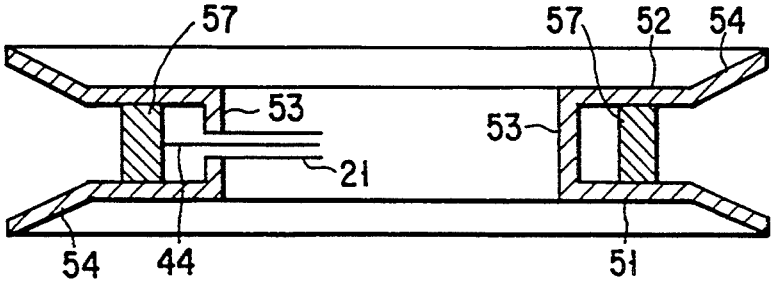
FIG. 53 is a sectional view taken along line 53—53 of FIG. 52

FIGS. 52 and 53 show another antenna. This antenna has a lower conductor plate 51 and an upper conductor plate 52, which are cylindrical. A cylindrical space is formed between the conductor plates 51 and 52. On the ends of the internal circumference of the cylindrical conductor plates 51 and 52, a wall 53 is formed to close the internal circumference of the cylindrical space.

In the internal circumference portion of the cylindrical space between the conductor plates 51 and 52, a cylindrical dielectric strip 57 is placed. This dielectric strip 57, whose construction is the same as that shown in FIGS. 50 and 51, has electrically asymmetric portions, such as cutouts, formed in it at specified intervals. The dielectric strip 57 is powered by a central conductor 44 of a coaxial line 21.

The outer circumference portions of the lower conductor plate 51 and the upper conductor plate 52 form a horn portion 54 that opens oscually as shown in FIG. 53. Consequently, the outer circumference portion of the space between the conductor plates 51 and 52 also has a cross section shaped like a horn.

With this antenna, the dielectric strip 57 radiates electromagnetic waves into the space between the conductor plates 51 and 52. The electromagnetic waves are radiated uniformly in all directions along the circumference from the horn portion 54 formed at the outer circumference portion of the conductor plates 51 and 52. This antenna is simple in construction and has high efficiency.

Figure 54:
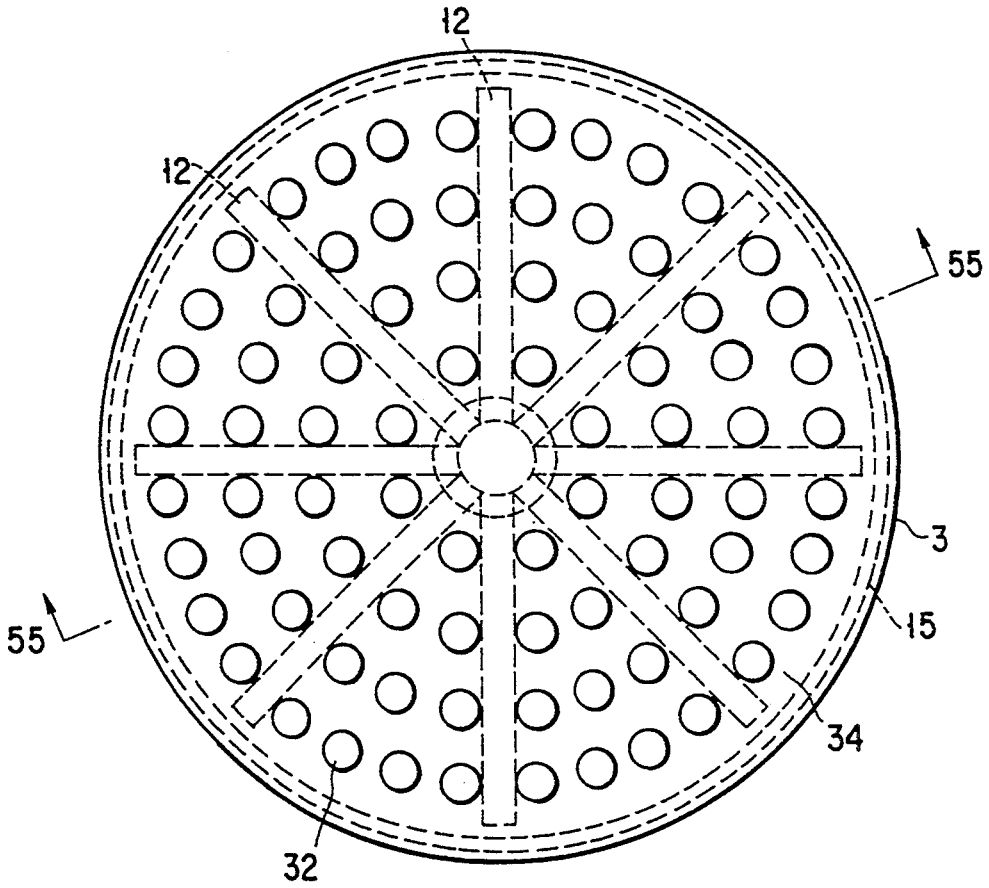
FIG. 54 is a plan view of another plane antenna.
Figure 55:
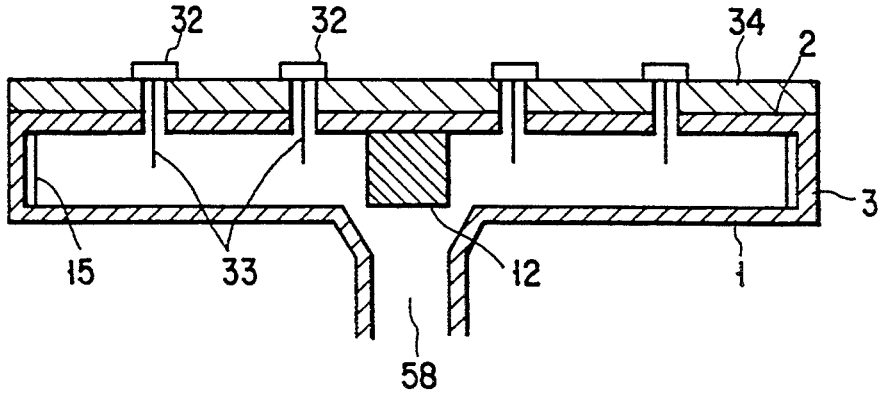
FIG. 55 is a sectional view taken along line 55—55 of FIG. 54.

FIGS. 54 and 55 show another antenna, which is a round plane antenna. This antenna has disk-like conductor plates 1 and 2. A round printed board 34 is provided on the upper conductor plate 2, and patch antennas 32 are provided on the printed board 34. Between the disk-like conductor plates 1 and 2, dielectric strips 12 are placed radially. One end of the dielectric strips 12 are located near the central portion of the conductor plates 1 and 2. Power is supplied to the one end of the dielectric strips 12 via a waveguide 58. The antenna of this embodiment has the same construction as that shown in FIGS. 48 and 49 except for the above construction.

For radiation elements used in the antennas explained above, various elements may be used.

Figure 56:
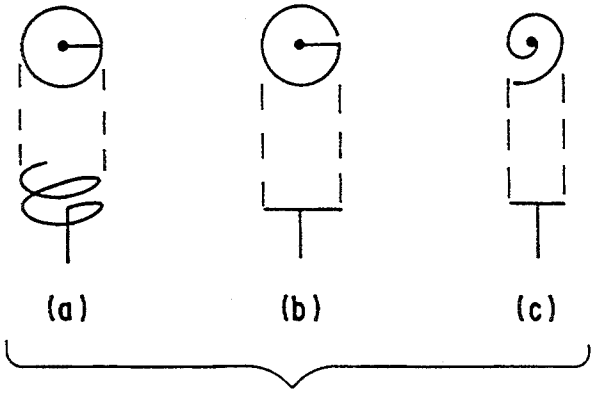
FIG. 56 is an explanatory diagram for various helical coil elements.

For example, in FIG. 56, (*a*) through (*c*) show various helical antenna elements that can be used as radiation elements for antennas of the present invention.

Figure 57:
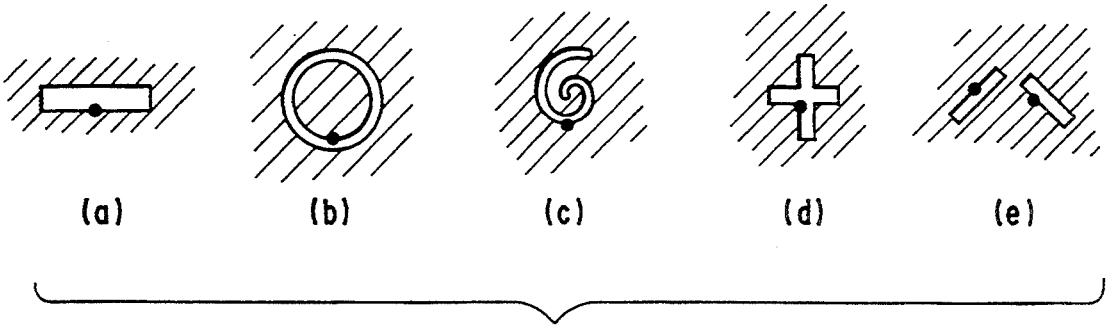
FIG. 57 shows plan views of various slot elements.

In FIG. 57, (*a*) through (*e*) show various slot antenna elements that can be used as radiation elements for antennas of the present invention.

Figure 58:
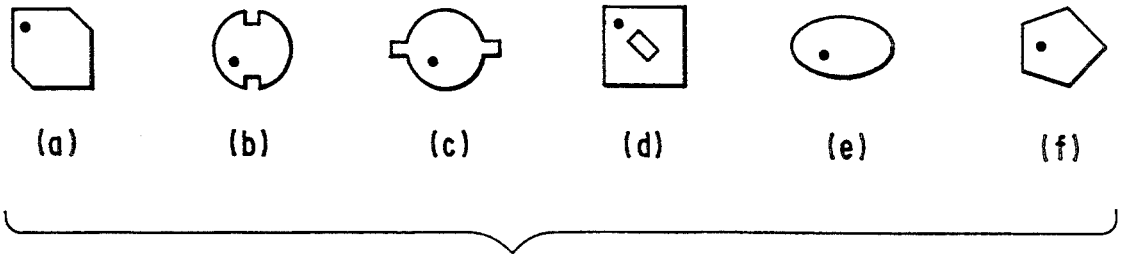
FIG. 58 shows plan views of various patch antenna elements.

In FIG. 58, (*a*) through (*f*) show various patch antenna elements that can be used as radiation elements for antennas of the present invention.

For the antennas described above, the radiation elements are placed in the positions where the electric field or magnetic field formed between the conductor plates by the leaky NRD waveguide becomes maximal. By shifting the radiation elements from the positions, however, a beam tilted with the direction perpendicular to the conductor plates can be radiated.

For example, when this antenna is used as a receiving plane antenna for satellite broadcasting, if the beam tilt angle is set according to the arrival angle of the radio wave from the a broadcasting satellite, it is not necessary to position the plane antenna perpendicularly to the direction of the radio wave arrival. Therefore, by setting the beam tilt angle suitably, radio wave can be received efficiently even if the plane antenna is positioned vertically along a building wall or the like.

Figure 59:
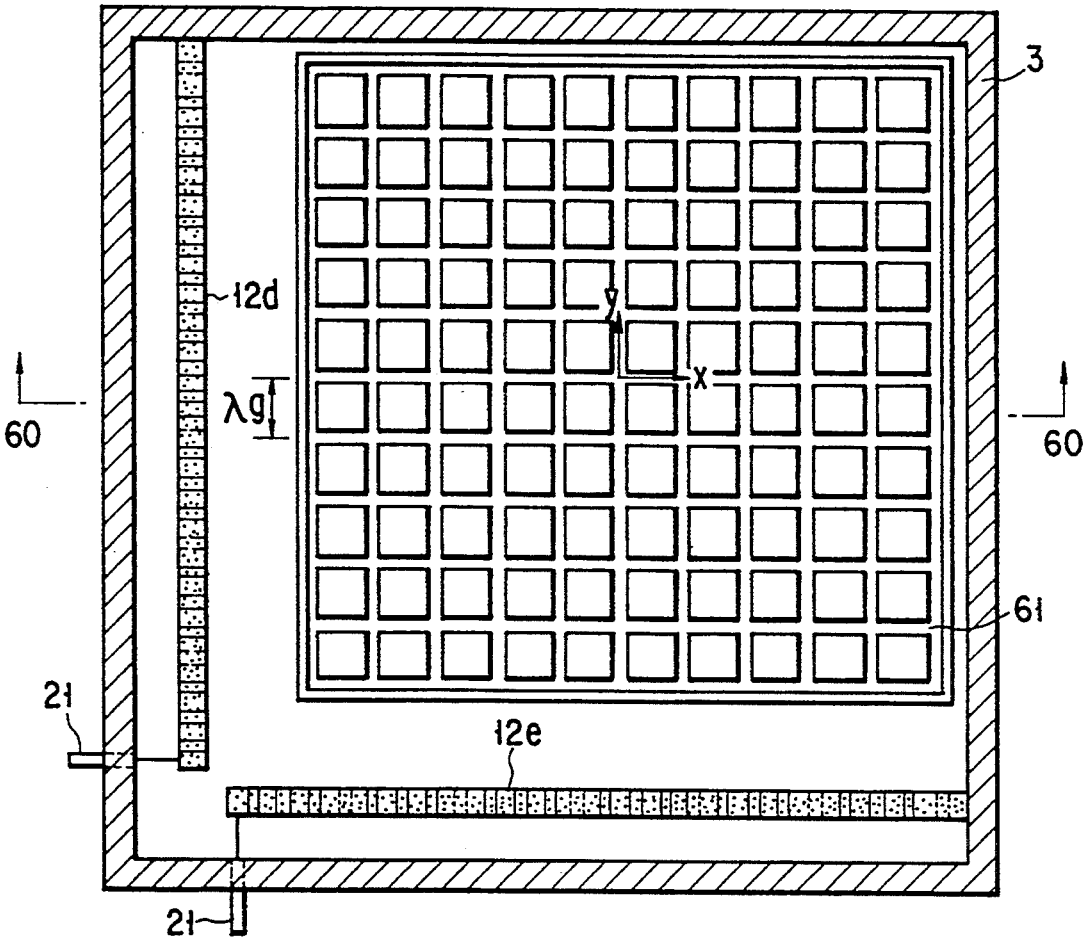
FIG. 59 is a plan view of another plane antenna.
Figure 60:
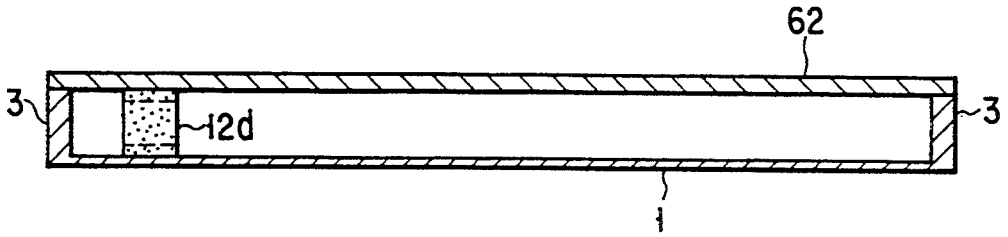
FIG. 60 is a sectional view taken along line 60—60 of FIG. 59.

FIGS. 59 and 60 show another antenna, which is used for circularly polarized wave with two power supply systems. In this antenna, a lower conductor plate 1 and a printed board 62 are placed a specified distance apart so as to be parallel with each other. A conductive coating is printed on the printed board 62, which acts as does an upper conductor plate.

In the printed board 62, a latticed slot antenna 61 is formed. This slot antenna 61 is constructed by removing the conductive coating of the printed board 62 into a lattice to form latticed openings.

A pair of dielectric strips 12*d* and 12*e* are placed along sides of the slot antenna crossing each other at right angles. The dielectric strips 12*d* and 12*e*, which are the same as explained above, are arranged so as to cross each other at right angles. The dielectric strips 12*d* and 12*e* are powered by two coaxial lines 21, respectively. Power is supplied to the dielectric strip 12*d* and 12*e* so that there may be a 90° phase difference between them.

The latticed slot antenna 61 is excited with a 90° phase difference by the dielectric strips 12*d* and 12*e* crossing each other at right angles, with the result that the slot antenna 61 radiates circularly polarized electromagnetic waves.

While the antenna in FIGS. 59 and 60 has been explained as an antenna for circularly polarized wave, linearly polarized electromagnetic wave could be radiated if only one of the pair of dielectric strips, that is, either dielectric strip 12*a* or 12*e* alone were excited.

Figure 61:
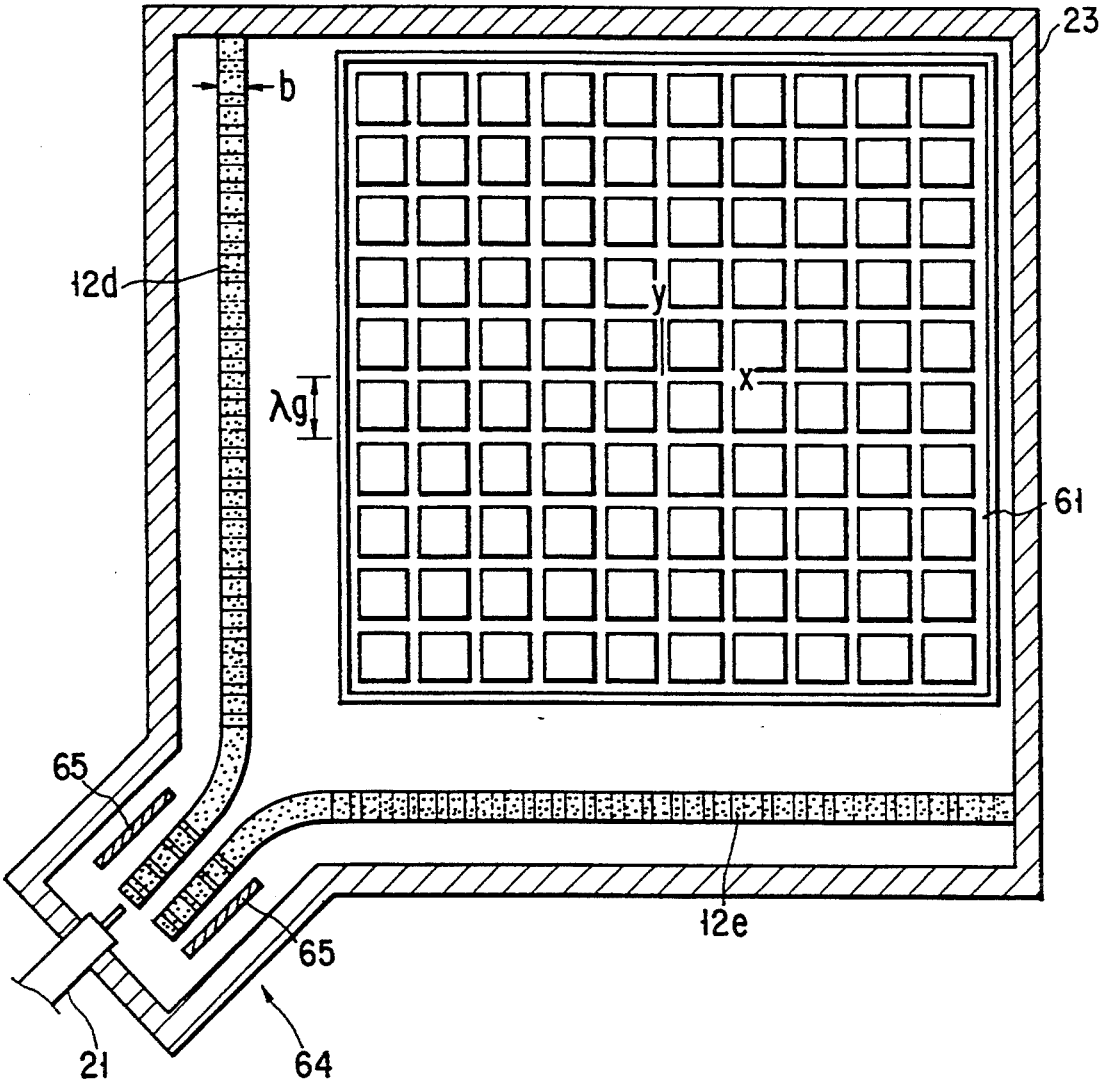
FIG. 61 is a plan view of another plane antenna.
Figure 62:
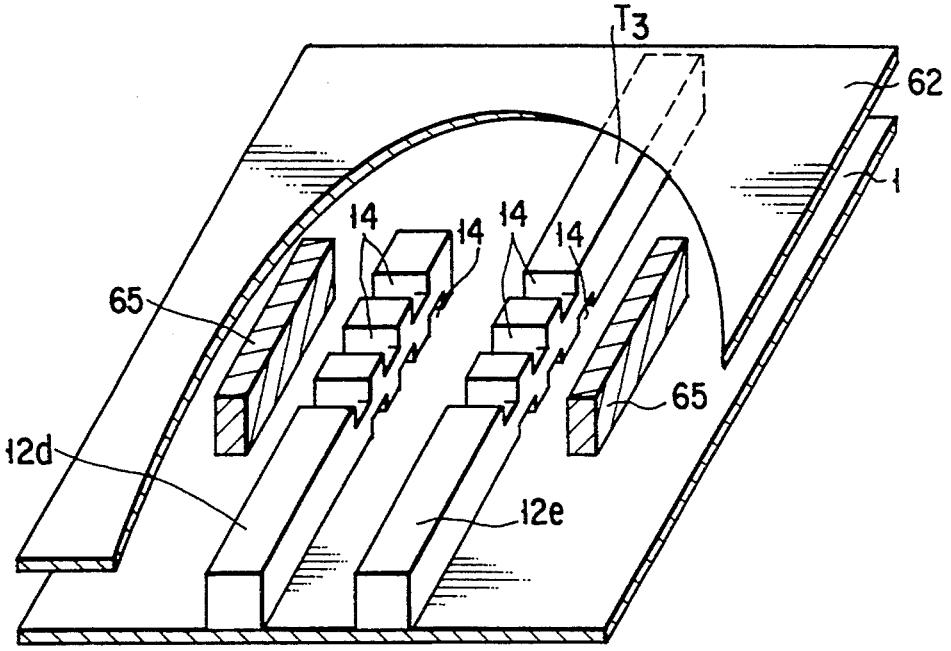
FIG. 62 is a perspective view of the power divider portion of FIG. 61.

FIGS. 61 and 62 show another mode of an antenna provided with a latticed slot antenna as described above. In this antenna, the ends of the pair of dielectric strips 12*d* and 12*e* are connected by a power divider 64, and a single coaxial line 21 supplies power to the two dielectric strips 12*d* and 12*e*.

FIG. 62 shows the power divider 64. The ends of the dielectric strips 12*d* and 12*e* are positioned in parallel with each other a specified distance apart. In the ends, cutouts 14 are formed. On both sides of the dielectric strips, a pair of reflection blocks 65 are placed in parallel with them. The reflection blocks 65 are made of a conductive material such as metal.

With such a power divider 64, the electromagnetic wave radiated from one dielectric strip 12*d* is reflected by the pair of reflection blocks 65 to form a standing wave between them. Consequently, the dielectric strips 12*d* and 12*e* are connected efficiently. By setting the position of the ends of the dielectric strips 12*d* and 12*e* and the reflection blocks 65, the dielectric strips can be connected with the phase difference added to the ends of the dielectric strips.

Figure 63:
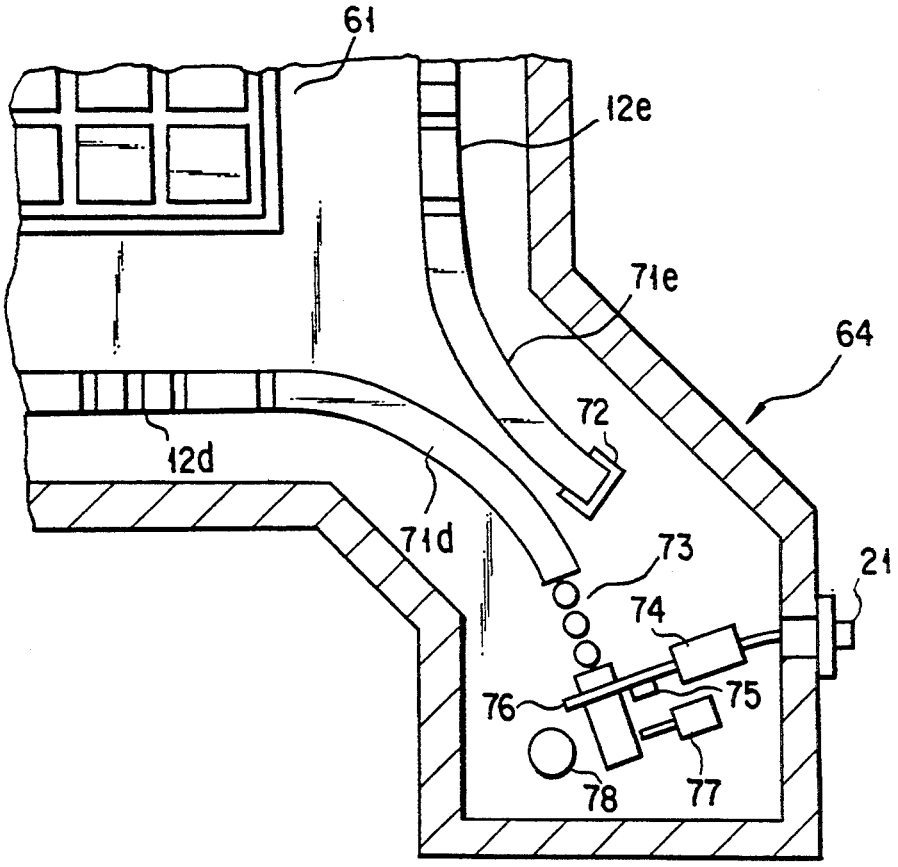
FIG. 63 is a plan view of mixer circuit of another plane antenna.

FIG. 63 shows a mixer circuit as another example of the connecting circuit used for the antenna for circularly polarized wave. In the mixer circuit, an absorbing resistive element 72 is fitted to the tip of one end 71*e* of the ends 71*d* and 71*e* of the pair of dielectric strips 12*d* and 12*e* to prevent reflection at the tip.

At the end 71*d* of the other dielectric strip 12*d*, a filter 73 is formed to prevent local oscillation. The other end 71*d* is connected to the power feed line 21 via a mixer 76, an intermediate frequency (IF) filter 75, and an IF amplifier 74. Near the end 71*d*, a local oscillator 77 is provided. the input to the antenna is mixed at the local oscillator 77 to produce a high-frequency power of an intermediate frequency (IF). On the opposite side of the local oscillator 77, a dielectric resonator 78 is provided, which has a high Q and stabilizes the frequency at the local oscillator 77.

The IF power produced at the local oscillator 77 is transmitted through the mixer 76 and the IF filter 75 to the IF amplifier 74, which then amplifies the power.

Although only the fundamental functions of the antennas have been explained, a practical construction is used actually. For example, FIG. 64 shows an example of a construction employed when antennas as described above are manufactured actually.

This antenna has a tray-like body where a lower conductor plate 1 and a sidewall portion 3 are formed integrally. A dielectric spacer 66 is filled between the lower conductor plate 1 and the upper conductor plate 2. On the upper conductor plate, a dielectric spacer 67 is laid, on which a cover 68 of a synthetic resin material is placed. The cover 68 is provided with a sidewall portion 69. Projecting portions 70 formed on the inner circumference of the sidewall portion 69 engage with recessed portions formed in the outer circumference of the body portion. This engagement combines all components into one unit and provides waterproofing.

Figure 64:
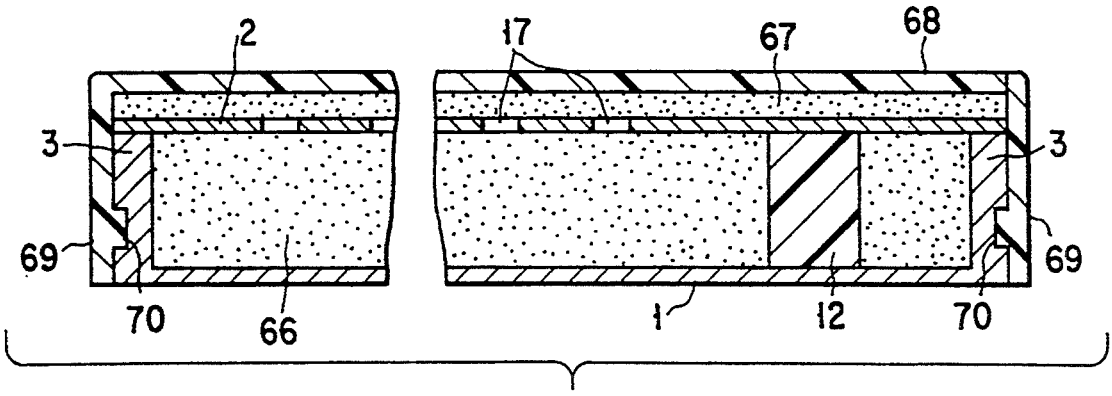
FIG. 64 is a sectional view showing the construction of a practical plane antenna.

In the antenna show in FIG. 64, the dielectric strip 12 is made of the above material such as Teflon, polystyrol plastic, or polystryene plastic. The dielectric spacers 66 and 67 are formed of a low-permittivity material such as expanded polyetheylene plastic. The upper conductor plate 2 is a metal plate in which radiation slots are made as mentioned above. For the upper conductor plate 2, a printed board may be used which is produced by forming a coating of a conductive material on a board made of a dielectric material and then making radiation slots and various radiation elements through printing and etching, as described above.

Figure 65:
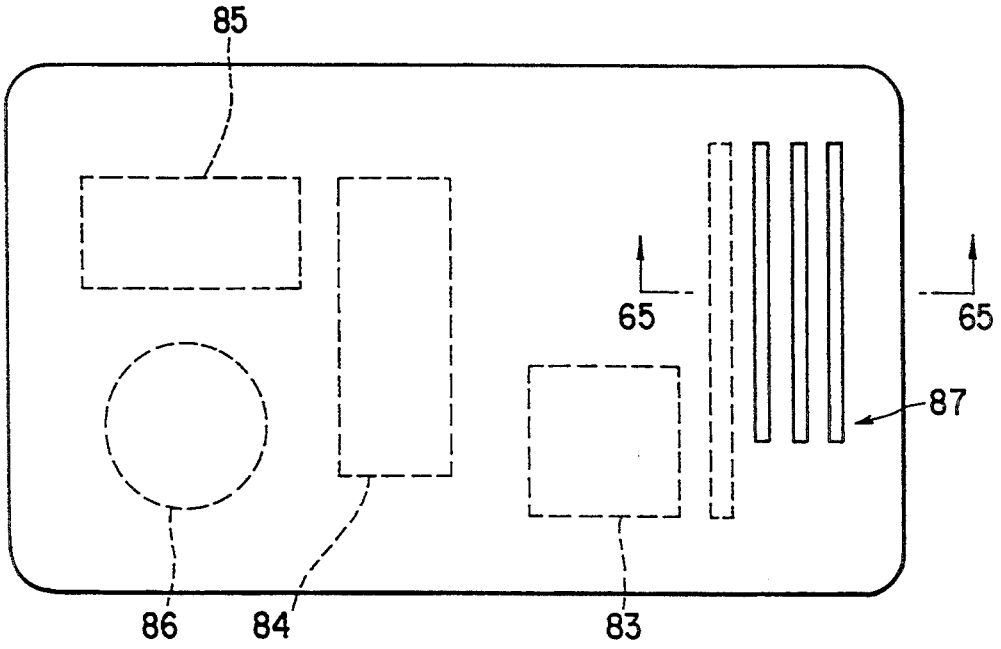
FIG. 65 is a plan view of an IC card.
Figure 66:
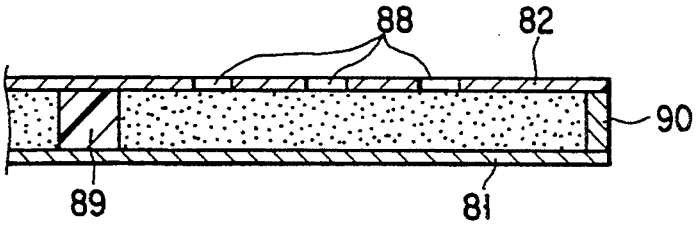
FIG. 66 is a sectional view taken along line 65—65 of FIG. 64.

Further, the present invention is not restricted to the above-described antennas. For example, FIGS. 65 and 66 show an example of an IC card using an electromagnetic radiator of the present invention. This IC card has a pair of metal plates 81 and 82, one on each side, which serving as conductor plates. The IC card incorporates a transmitter circuit 83, a CPU 84, a memory 85, a battery 86, and others. At one end of the IC card, an electromagnetic radiator portion 87 is formed.

FIG. 66 shows the construction of the electromagnetic radiator portion 87. In this construction, a dielectric strip 89 as mentioned above is placed between a pair of metal plates 81 and 82. The dielectric strip 89 is connected to the transmitter circuit 83. At the ends of the metal plates 81 and 82, a reflection wall 90 is formed. In one metal plate 82, radiation slots 88 are formed at specified intervals. In the electromagnetic radiator portion, as in the above-described antennas, the dielectric strip 89 excites the radiation slots 88 to radiate electromagnetic waves. By means of this electromagnetic wave, the transmitter circuit 83 allows the transmission and reception of signal between the IC card and an external transmitter.

The optimum distance between the metal plates 81 and 82, or the conductor plates is approximately half the wavelength of the electromagnetic wave radiated. Therefore, using electromagnetic waves of several tens of GHz makes the distance between the metal plates several millimeters, which provides a thin, compact IC card.

Such an IC card enables the transmission and reception of signals via electromagnetic waves. Because no electrical contact is required, a highly reliable IC card can be obtained.

Because of the ability to transmit and receive signals over the range from several tens of millimeter to several hundreds of meters, such an IC card finds its way into various uses. For example, a security management system, which monitors and manages the passage of people and cars and the coming and going of people in and out of facilities, can be constructed by having people or cars carry such IC cards with them. The IC card is so thin that it can be curved, which makes it possible to stick the card on a part of the car body.

Electromagnetic radiators, such as antennas, of the present invention are simple in construction, thin, compact, and high in efficiency. By installing a small antenna of the invention on the external surface of the body of a car, it can be used as an antenna for a Doppler radar-type anti-collision unit. Similarly, by installing an antenna of the present invention on the body of a car, a traffic management system can be constructed which allows the electronic unit to transmit and receive signals to and from the transmitter-receiver facilities installed along the roads to collect and provide traffic information, and others.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An electromagnetic radiator using a leaky NRD waveguide for radiating and receiving an electromagnetic wave, including a high-frequency electromagnetic wave, comprising:

a pair of conductor plates arranged a distance apart from each other to form a space therebetween, the distance being less than a half of a wavelength of said electromagnetic wave;

a dielectric strips made of a dielectric material and arranged between said pair of conductor plates, and wherein said dielectric strips together with said pair of conductor plates are arranged to form an NRD waveguide;

electrically asymmetric portions formed in a part of said NRD waveguide which includes said dielectric strips and said pair of conductor plates, and wherein said electrically asymmetric portions together with said NRD waveguide form said leaky NRD waveguide, said electrically asymmetric portions being provided at regular intervals and radiating high-frequency power, which is transmitted in said leaky NRD waveguide as an electromagnetic wave, to said space between said pair of conductor plates;

radiation means for radiating said electromagnetic wave, which is radiated to said space between said pair of conductor plates, to the outside of said electromagnetic radiator; and power supply means for supplying high-frequency power to said leaky NRD waveguide.

2. An electromagnetic radiator according to claim 1, wherein said electrically asymmetric portions comprise cutouts which are formed in said dielectric strips at intervals equal to the wavelength ($\lambda g$) of the high-frequency power supplied by said power supply means.

3. An electromagnetic radiator according to claim 1, wherein said electrically asymmetric portions comprise recess portions which are formed in said at least one of said conductor plates at positions corresponding said dielectric strips.

4. An electromagnetic radiator according to claim 1, wherein said radiation means comprises a radiation slot element formed in said conductor plates.

5. An electromagnetic radiator according to claim 1, wherein said dielectric strips are arranged in parallel with each other and are supplied with high-frequency power of the same phase.

6. An electromagnetic radiator according to claim 1, wherein said space between said pair of conductor plates has an open portion which is open to the outside of said electromagnetic radiator at the ends of the conductor plates, and the electromagnetic wave radiated from the electrically asymmetric portions of said dielectric strip into said space between said pair of conductor plates is radiated from said open portion of the outside of said electromagnetic radiator.

7. An electromagnetic radiator according to claim 1, further comprising an image plate made of a conductive material and which is arranged along one side of a dielectric strip.

8. An electromagnetic radiator according to claim 1, wherein said conductor plates are arranged in at least a part of an IC card provided with a memory circuit, a computing circuit, and a transmitter circuit, with said dielectric strips being arranged between said conductor plates.

9. An electromagnetic radiator according to claim 1, wherein said pair of conductor plates and a dielectric strip are electrically symmetrical in a vertical direction, except in an asymmetric portion of the NRD waveguide.

10. An electromagnetic radiator according to claim 1, wherein said conductor plates are arranged to transmit a high frequency electromagnetic wave in the NRD waveguide such that an electric field of the high frequency electromagnetic wave is generated in parallel with said pair of conductor plates.

11. An electromagnetic radiator using a leaky NRD waveguide for radiating and receiving electromagnetic waves, including high-frequency electromagnetic waves, comprising:

a pair of conductor plates arranged a specified distance apart from each other to form a space therebetween;

a dielectric strip made of a dielectric material, arranged between the pair of conductor plates, and wherein said dielectric strip together with the pair of conductor plates are arranged to form an NRD waveguide;

an electrically asymmetric portion formed in a part of the NRD waveguide which includes the dielectric strip and the pair of conductor plates, and wherein said electrically asymmetric portion together with the NRD waveguide forms said leaky NRD waveguide; and power supply means for supplying high-frequency power to the leaky NRD waveguide;

wherein said pair of conductor plates extend on at least one side of said dielectric strip and are provided with at least one radiation element formed in at least one of said pair of conductor plates, said at least one radiation element being excited by an electromagnetic wave radiated from an electrically asymmetric portion of said dielectric strip into the space between said pair of conductor plates to radiate electromagnetic waves;

wherein at least one of said pair of conductor plates comprises a printed board; and wherein said at least one radiation element comprises a patch antenna element formed on said printed board.

12. An electronic radiator according to claim 11, wherein said printed board comprises a conductive coating thereon which serves as a conductor plate.

13. An electromagnetic radiator using a leaky NRD waveguide for radiating and receiving electromagnetic waves, particularly high-frequency electromagnetic waves, comprising:

a pair of conductor plates arranged a specified distance apart to form a space therebetween;

a dielectric strip made of a dielectric material, arranged between the pair of conductor plates, and wherein the dielectric strip and the pair of conductor plates are arranged to form an NRD waveguide;

an electrically asymmetric portion formed in a part of the NRD waveguide which includes the dielectric strip and the pair of conductor plates, which, together with the NRD waveguide, forms said leaky NRD waveguide; and power supply means for supplying high-frequency power to the leaky NRD waveguide;

wherein said pair of conductor plates extend on at least one side of said dielectric strip and are provided with at least one radiation element formed in at least one of said pair of conductive plates, said at least one radiation element being excited by an electromagnetic wave radiated from the electrically asymmetric portion of said dielectric strip into the space between said pair of conductor plates to radiate electromagnetic waves; and wherein said dielectric strips are arranged at right angles with respect to each other and are supplied with high-frequency power of a different phase.

14. An electromagnetic radiator using a leaky NRD waveguide for radiating and receiving electromagnetic waves, particularly high-frequency electromagnetic waves, comprising:

a pair of conductor plates arranged a specified distance apart to form a space therebetween;

a dielectric strip made of a dielectric material, arranged between the pair of conductor plates, and wherein the dielectric strip and the pair of conductor plates are arranged to form an NRD waveguide;

an electrically asymmetric portion formed in a part of the NRD waveguide which includes of the dielectric strip and the pair of conductor plates, which, together with the NRD waveguide, forms said leaky NRD waveguide; and power supply means for supplying high-frequency power to the leaky NRD waveguide; and wherein said pair of conductor plates are spherical and extend on at least one side of said dielectric strip, and further comprising at least one radiation element formed in at least one of said pair of conductor plates, said at least one radiation element being excited by an electromagnetic wave radiated from the electrically asymmetric portion of said dielectric strip into the space between said pair of conductor plates to radiate electromagnetic waves.

15. An electromagnetic radiator using a leaky NRD waveguide for radiating and receiving electromagnetic waves, particularly high-frequency electromagnetic waves, comprising:

a pair of conductor plates arranged a specified distance apart;

a dielectric strip made of a dielectric material, arranged between the pair of conductor plates, and wherein the dielectric strip and the pair of conductor plates are arranged to form an NRD waveguide;

an electrically asymmetric portion formed in a part of the NRD waveguide which includes the dielectric strip and the pair of conductor plates, which, together with the NRD waveguide, forms said leaky NRD waveguide; and power supply means for supplying high-frequency power to the leaky NRD waveguide;

wherein said electrically asymmetric portion comprises a cutout formed in a part of said dielectric strip; and wherein a material whose permittivity is higher than that of the material forming said dielectric strip is filled in said cutout.

16. An electromagnetic radiator using a leaky NRD waveguide for radiating and receiving electromagnetic waves, including high-frequency electromagnetic waves, comprising:

a pair of conductor plates arranged a specified distance apart;

a dielectric strip made of a dielectric material, arranged between the pair of conductor plates, and wherein the dielectric strip and the pair of conductor plates are arranged to form an NRD waveguide;

an electrically asymmetric portion formed in a part of the NRD waveguide which includes the dielectric strip and the pair of conductor plates, which, together with the NRD waveguide, forms said leaky NRD waveguide; and power supply means for supplying high-frequency power to the leaky NRD waveguide;

wherein said electrically asymmetric portion comprises a recessed portion formed in a portion of said conductor plate corresponding to the part of said dielectric strip; and wherein a material whose permittivity is higher than that of the material forming said dielectric strip is filled in said recessed portion.

17. An electromagnetic radiator using a leaky NRD waveguide for radiating and receiving electromagnetic waves, including high-frequency electromagnetic waves, comprising:

a pair of conductor plates arranged a specified distance apart;

a dielectric strip made of a dielectric material, arranged between the pair of conductor plates, and wherein the dielectric strip and the pair of conductor plates are arranged to form an NRD waveguide;

a plurality of electrically asymmetric portions formed in a part of the NRD waveguide which includes the dielectric strip and the pair of conductor plates, which, together with the NRD waveguide, forms said leaky NRD waveguide; and power supply means for supplying high-frequency power to the leaky NRD waveguide; and wherein said electrically asymmetric portions of said dielectric strip are arranged alternately on a top face and a bottom face of the dielectric strip at intervals corresponding to half the wavelength of the high-frequency power supplied.

18. An electromagnetic radiator using a leaky NRD waveguide for radiating and receiving electromagnetic waves, including high-frequency electromagnetic waves, comprising:

a pair of conductor plates arranged a specified distance apart;

a dielectric strip made of a dielectric material, arranged between the pair of conductor plates, and wherein the dielectric strip and the pair of conductor plates are arranged to form an NRD waveguide;

a plurality of electrically asymmetric portions formed in the dielectric strip, and which, together with the NRD waveguide, forms said leaky NRD waveguide;

power supply means for supplying high-frequency power to the leaky NRD waveguide; and reflection cutouts formed in said dielectric strip, said reflection cutouts being vertically symmetric and being arranged to create internal reflections in the waveguide; and wherein said electrically asymmetric portions are shifted in the dielectric strip by one-fourth of the wave-length of the supplied high-frequency power away from the reflection cutouts.

19. An electromagnetic radiator according to claim 18, wherein said electrically asymmetric portions comprise respective cutouts for radiating electromagnetic waves therefrom.

20. An electromagnetic radiator using a leaky NRD waveguide for radiating and receiving electromagnetic waves, including high-frequency electromagnetic waves, comprising:

a pair of conductor plates arranged a specified distance apart;

a dielectric strip made of a dielectric material, arranged between the pair of conductor plates, and wherein the dielectric strip and the pair of conductor plates are arranged to form an NRD waveguide;

an electrically asymmetric portion formed in a part of the NRD waveguide which includes the dielectric strip and the pair of conductor plates, which, together with the NRD waveguide, forms said leaky NRD waveguide; and power supply means for supplying high-frequency power to the leaky NRD waveguide; and wherein the electrically asymmetric portion of said dielectric strip comprises a pair of cutouts formed vertically symmetrically in a same position, with one cutout filled with a material whose permittivity is higher than that of the material forming the dielectric strip, and the other cutout filled with a material whose permittivity is lower than that of the material forming the dielectric strip.

21. An electromagnetic radiator using a leaky NRD waveguide for radiating and receiving electromagnetic waves, particularly high-frequency electromagnetic waves, comprising:

a pair of conductor plates arranged a specified distance apart;

a dielectric strip made of a dielectric material, arranged between the pair of conductor plates and wherein the dielectric strip and the pair of conductor plates are arranged to form an NRD waveguide;

an electrically asymmetric portion formed in a part of the NRD waveguide which includes the dielectric strip and the pair of conductor plates, which, together with the NRD waveguide, forms said leaky NRD waveguide; and power supply means for supplying high-frequency power to the leaky NRD waveguide; and wherein said dielectric strip has ends which are arranged close to each other, with electrically asymmetric portions formed at said ends, reflection walls are arranged on both sides of said ends and are placed close to each other, and said ends are electromagnetically connected to each other to form a power divider circuit.

* * * * *

UNITED STATES PATENT AND TRADEMARK OFFICE

CERTIFICATE OF CORRECTION

PATENT NO. :5,416,492

DATED :May 16, 1995

INVENTOR(S) :TAKAHASHI et al

It is certified that error appears in the above-identified patent and that said Letters Patent is hereby corrected as shown below:

Title page:

Item [75] Inventors, line 5, "981-31" should be --981-11--

Item [73] Assignees, line 2, "Yonehara" should be --Yoneyama--

Signed and Sealed this

Sixteenth Day of January, 1996

*Attest:*

Bruce Lehman

BRUCE LEHMAN

*Attesting Officer*

*Commissioner of Patents and Trademarks*